United States Patent [19]

Phillips et al.

[11] 4,332,761

[45] Jun. 1, 1982

[54] PROCESS FOR MANUFACTURE OF TEXTILE FILAMENTS AND YARNS

[75] Inventors: Bobby M. Phillips; James O. Casey, Jr.; Dale R. Gregory, all of Kingsport, Tenn.

[73] Assignee: Eastman Kodak Company, Rochester, N.Y.

[21] Appl. No.: 193,063

[22] Filed: Oct. 2, 1980

Related U.S. Application Data

[60] Division of Ser. No. 36,712, May 7, 1979, Pat. No. 4,245,001, which is a continuation of Ser. No. 834,034, Sep. 16, 1977, abandoned, which is a continuation of Ser. No. 763,258, Jan. 26, 1977, abandoned.

[51] Int. Cl.[3] ..... B29H 7/18

[52] U.S. Cl. ..... 264/147; 264/103; 264/177 F; 264/290.5

[58] Field of Search ..... 428/338, 373; 264/177 F, 147, 103, 290.5

[56] References Cited

U.S. PATENT DOCUMENTS

| | | | |
|---|---|---|---|
| 2,816,349 | 12/1957 | Pomm et al. | 264/85 |
| 3,078,544 | 2/1963 | Shealy | 264/177 F |
| 3,135,646 | 6/1964 | Hayden | 264/177 F |
| 3,219,739 | 11/1965 | Breen et al. | 264/177 F |
| 3,273,771 | 9/1966 | Beaumont | 264/177 F |
| 3,470,685 | 10/1969 | Hall et al. | 264/177 F |
| 3,914,488 | 10/1975 | Gorrafa | 264/177 F |
| 4,245,001 | 1/1981 | Phillips et al. | 428/373 |

FOREIGN PATENT DOCUMENTS

| | | | |
|---|---|---|---|
| 741739 | 11/1943 | Fed. Rep. of Germany | 264/177 F |
| 43-523 | 1/1968 | Japan | 264/177 F |
| 43-4554 | 2/1968 | Japan | 264/177 F |
| 49-36057 | 9/1974 | Japan | 264/177 F |
| 50-95513 | 7/1975 | Japan | 264/177 F |

*Primary Examiner*—Jay H. Woo

*Attorney, Agent, or Firm*—William P. Heath, Jr.; Daniel B. Reece, III

[57] ABSTRACT

Multifilament yarns comprising continuous multifilaments each having at least one body section and having extending therefrom along its length at least one wing member, the body section comprising about 25 to about 95% of the total mass of the filament and the wing member comprising about 5 to about 75% of the total mass of filament, the filament being further characterized by a wing-body interaction defined by $$\left(\frac{(D\max - D\min)D\min}{2Rc^2}\right)\left(\frac{Lw}{D\min}\right)^2 \geqq 10$$

where the ratio of the width of said fiber to the wing thickness ($L_T$/Dmin) is $\leqq 30$. Also disclosed are specific yarns and processes for producing the filaments and yarns.

The spun-like character of the fractured yarns of this invention is provided by the wing members extending from and along the body section being intermittently separated from the body section and a fraction of the separated wing members being broken to provide free protruding ends extending from the body section.

6 Claims, 49 Drawing Figures

$b=1$
$1 \leq a \leq 3$
$2 \leq c \leq 6$
$12 \leq d \leq 48$ $b=1$
$1 \leq a \leq 3$
$2 \leq c \leq 6$
$6 \leq d \leq 48$

PROCESS FOR MANUFACTURE OF TEXTILE FILAMENTS AND YARNS

This is a division of application Ser. No. 36,712 filed May 7, 1979 now U.S. Pat. No. 4,245,001, which is a continuation of copending U.S. Ser. No. 834,034 filed Sept. 16, 1977, now abandoned which in turn is a continuation of U.S. Ser. No. 763,258 filed Jan. 26, 1977 and is now abandoned.

This invention relates to novel synthetic filaments having free protruding ends, to synthetic filaments having a special geometry to give controlled fracturability, to yarns made from the fractured filaments and to processes for producing the filaments and yarns.

Historically, fibers used by man to manufacture textiles, with the exception of silk, were of short length. Vegetable fibers such as cotton, animal fibers such as wool, and bast fibers such as a flax all had to be spun into yarns to be of value in producing fabrics. However, the very property of short staple length of these fibers requiring that the yarns made therefrom be spun yarns also resulted in bulky yarns having very good covering power, good insulating properties and a good, pleasing hand.

The operations involved in spinning yarns from staple fibers are rather extensive and thus are quite costly. For example, the fibers must be carded and formed into slivers and then be subsequently drawn to reduce the diameter and finally be spun into yarn.

Many previous efforts have been made to produce spun-like yarns from continuous filament yarns. For example, U.S. Pat. No. 2,783,609 discloses a bulky continuous filament yarn wich is described as individual filaments individually convoluted into coils, loops and whorls at random intervals along their lengths, and characterized by the presence of a multitude of ring-like loops irregularly spaced along the yarn surface. U.S. Pat. No. 3,219,739 discloses a process for preparing synthetic fibers having a convoluted structure which imparts high bulk to yarns composed of such fibers. The fibers or filaments will have 20 or more complete convolutions per inch but it is preferred that they have at least 100 complete convolutions per inch. Yarns made from these convoluted filaments do not have free protruding ends like spun or staple yarns and are thus deficient in tactile aesthetics.

Other multifilament yarns which are bulky and have spun-like character include yarns such as that shown in U.S. Pat. No. 3,946,548 wherein the yarn is composed of two portions, i.e., a relatively dense portion and a blooming, relatively sparse portion, alternately occurring along the length of the yarn. The relatively dense portion is in a partially twisted state and individual filaments in this portion are irregularly entangled and cohere to a greater extent than in the relatively sparse portion. The relatively dense portion has protruding filament ends on the yarn surface in a larger number than the relatively sparse portion. The protruding filaments are formed by subjecting the yarn to a high velocity fluid jet to form loops and arches on the yarn surface and then false twisting the yarn bundle and then passing the yarn over a friction member, thereby cutting at least some of the looped and arched filaments on the yarn surface to form filament ends.

Yarns such as the texturized yarns disclosed in U.S. Pat. No. 2,783,609 and bulky multifilament yarns disclosed in U.S. Pat. No. 3,946,548 have their own distinctive characteristics but do not achieve the hand and appearance of the yarns made in accordance with our invention.

Many attempts have been made to produce bulky yarns having the aesthetic qualities and covering power of spun staple yarns without the necessity of extruding continuous filaments or formation of staple fibers as an intermediate step. For example, U.S. Pat. No. 3,242,035 discloses a product made from a fibrillated film. The product is described as a multifibrous yarn which is made up of continuous network of fibrils which are of irregular length and have a trapezoidal cross-section wherein the thin dimension is essentially the thickness of the original film strip. The fibrils are interconnected at random points to form a cohesively unitary or one-piece network structure, there being essentially very few separate and distinct fibrils existing in the yarn due to forces of adhesion or entanglement.

In U.S. Pat. No. 3,470,594 there is disclosed another method of making a yarn which has a spun-like appearance. Here, a strip of ribbon of striated film is highly oriented uniaxially in the longitudinal direction and is split into a plurality of individual filaments by a jet of air or other fluid impinging upon the strip in a direction substantially normal to the ribbon. The final product is described as a yarn in which individual continuous filaments formed from the striation are very uniform in cross-section lengthwise of the filaments. At the same time, there is formed from a web a plurality of fibrils having a reduced cross-section relative to the cross-section of the filament. FIGS. 8 and 9 of U.S. Pat. No. 3,470,594 show the actual appearance of yarn made in accordance with the disclosure.

The fibrillated film yarns of the prior art, which are generally characterized by the two disclosures identified above, have not been found to be useful in a commerical sense as a replacement or substitute for spun yarns made of staple fibers. These fibrillated film type yarns do not possess the necessary hand, the necessary strength, yarn uniformity, dye uniformity, or aesthetic structure to be used as an acceptable replacement or substitute for spun yarns for producing knitted and woven apparel fabrics.

Yarns of the type disclosed in U.S. Pat. Nos. 3,857,232 and 3,857,233 are bulky yarns with free protruding ends and are produced by joining two types of filaments together in the yarn bundle. Usually one type filament is a strong filament with the other type filament being a weak filament. One unique feature of the yarns is that the weak filaments are broken in the false twist part of a draw texturing process. The relatively weak filaments which are broken are subsequently entangled with the main yarn bundle via an air jet. Even though these yarns are bulky like staple yarns and have free protruding ends like spun yarns, fabrics produced from these yarns have aesthetics which are only slightly different from fabrics made from false twist textured yarns.

Yarns of this invention have a spun yarn character, the yarn comprising a bundle of continuous filaments, the filaments having a continuous body section with at least one wing member extending from and along the body section, the wing member being intermittently separated from the body section, and a fraction of the separated wing members being broken to provide free protruding ends extending from the body section to provide the spun yarn character of the continuous filament yarn. The yarn is further characterized in that portions of the wing member are separated from the body section to form bridge loops, the wing member portion of said loop being attached at each end thereof to said body section, said wing member portion of said bridge loop being shorter in length than the corresponding body section portion.

The free protruding ends extending from the filaments have a mean separation distance along a filament of about one to about ten millimeters and have a mean length of about one to about ten millimeters. The free protruding ends are randomly distributed along the filaments. The probability density function of the length of the free protruding ends on each individual filament is defined by $$f(x) = \frac{H(x)}{\int_{o}^{\infty} H(x)dx}, \; x > 0, \text{ otherwise } f(x) = 0$$

where f(x) is the probability density function $$\text{and } H(x) = \int_{-x}^{x} \tfrac{1}{2}\,\alpha\, e^{-\alpha(\frac{x+z}{2})-\beta/(\frac{x+z}{2})} R(\tfrac{x-z}{2})dz$$

and R(ξ) is the log normal probability density function whose means is $\mu_2 + \ln w$ and variance is $\sigma_2^2$ or where $\mu_2$ = mean value of $\ln(\mathrm{COT}\theta)$ with $\theta$ = angle at which tearing break makes to fiber axis and w = width of the wing or $$R(\xi) = \frac{1}{\xi\sigma 2\sqrt{2\pi}}\, e^{[-\frac{1}{2}(\frac{\ln\xi - \ln w - \mu_2}{\sigma 2})2]}$$

and for $\mu_2 = 3.096$ $\sigma_2 = 0.450$ $0.11 \text{ mm}^{-1} \leqq \alpha \leqq 2.06 \text{ mm}^{-1}$ $0 \leqq \beta \leqq 1.25 \text{ mm}^{-1}$ $0.0085 \text{ mm} < w < 0.0173 \text{ mm}$ The free protruding ends have a preferential direction of protrusion from the individual filaments and greater than 50% of the free protruding ends initially protrude from the body member in the same direction.

The mean length of the wing member portion of the bridge loops is about 0.2 to about 10.0 millimeters and the mean separation distance of the bridge loops along a filament is about 2 to about 50 millimeters. The bridge loops are randomly distributed along the filaments.

The yarns of this invention comprise continuous multi-filaments, each having at least one body section and having extending therefrom along its length at least one wing member, the body section comprising about 25 to about 95% of the total mass of the filament and the wing member comprising about 5 to about 75% of the total mass of the filament, the filament being further characterized by a wing-body interaction defined by $$\left(\frac{(D\max - D\min)D\min}{2Rc^2}\right)\left(\frac{Lw}{D\min}\right)^2 \geqq 10$$

where the ratio of the width of said fiber to the wing thickness ($L_T$/Dmin) is ≧ 30. The significance of the above symbols will be discussed later herein. The body of each filiment remains continuous throughout the fractured yarn and thus provides load-bearing capacity, whereas the wings are broken and provide the free protruding ends.

The filaments may have one or more wings that are curved or the wings may be angular. The filaments may be provided with luster-modifying means which may be lobes extending along the length of the fiber and/or finely dispersed $TiO_2$ or kaolin clay. The body of the filaments may be round or nonround.

The filaments afer spinning are drawn, heatset, and subjected to an air jet to fracture the wing or wings to provide a yarn having spun-like characteristics.

The filaments and yarns of this invention are preferably made from polyester or copolyester polymer. Polymers that are particularly useful are poly(ethylene terephthalate) and poly (1,4-cyclohexylenedimethylene terephthalate). These polymers may be modified so as to be basic dyeable, light dyeable, or deep dyeable as is known in the art. These polymers may be produced as disclosed in U.S. Pat. Nos. 3,962,189 and 2,901,466, and by conventional procedures well known in the art of producing fiber-forming polyesters. Also the filaments and yarns can be made from polymers such as poly(butylene terephthalate), poly-propylene, or nylon such as nylon 6 and 66. However, the making of yarns described herein from these polymers is more difficult than the polyesters mentioned above. We believe this is attributable to the increased difficulty in making these polymers behave in a brittle manner during the fracturing process.

In general, it is well known in the art that the preservation of nonround cross-sections is dependent, among other things, on the viscosity-surface tension properties of the melt emerging from a spinneret hole. It is also well known that the higher the inherent viscosity (I.V.) within a given polymer type, the better the shape of the spinneret hole is preserved in the as-spun filament. These ideas obviously apply to the wing-body interaction parameter defined herein.

One major advantage of the yarns made according to this invention is the versatility of such yarns. For example, a yarn with high strength, high frequency of protruding ends, short mean protruding end length with a medium bulk can be made and used to give improved aesthetics in printed goods when compared to goods made from conventional false twist textured yarn. On the other hand, a yarn with medium strength, high frequency of protruding ends with medium to long protruding end length and high bulk can be made and used to give desirable aesthetics in jersey knit fabrics for underwear or for women's outerwear.

The versatility is achieved primarily by manipulating the fracturing jet pressure and the specific cross-section of the filament. In general, increasing the fracturing jet pressure increases the specific volume and decreases the strength of the yarn. By varying the cross-section of the filaments within the parameters set forth herein, such as for a given spinneret hole design having a center hole with slots on either side, the yarn strength at constant fracturing conditions increases with increasing hole diameter and the yarn specific volume increases with decreasing center hole diameter and increasing length/slot width (See FIGS. 10, 22, and 25).

Another major advantage of yarns made according to this invention, when compared to staple yarns, is their uniformity along their length as evidenced by a low % Uster value (described later herein). This property translates into excellent knittability and weavability with the added advantage that visually uniform fabrics can be produced which possess distinctively staple-like characteristics, a combination of properties which has been hitherto unachievable.

Another of the major advantages of yarns of this invention when compared to normal textile I.V. yarns in fabrics is excellent resistance to pilling. Random tumble ratings of 4 to 4.5 are very common (ASTM D-1375, "Pilling Resistance and Other Related Surface Characteristics of Textile Fabrics" ). This is thought to occur because of the lack of migration of the individual protruding ends in the yarns.

Another major advantage when compared to previous staple-like yarns is the ease with which these yarns can be withdrawn from the package. This is a necessary prerequisite for good processability.

The filaments of this invention may be prepared by spinning the polymer through an orifice which provides a filament cross-section having the necessary wing-body interaction and the ratio of the width of the filament to the wing thickness as set forth earlier herein. The quenching of the fiber (as in melt spinning) must be such as to preserve the required cross-section. The filament is then drawn, heat set to a density of at least 1.35 gm./cc. and subjected to fracturing forces in a high velocity fracturing jet. Although the shape of the filaments must remain within the limits described, slight variations in the parameters may occur along the length of the filament or from filament to filament in a yarn bundle without adversely affecting the unique properties.

The thickness of the wing(s) may vary up to about twice its minimum thickness and the greater thickness may be along the free edge of the wing. The yarns of this invention are made from fractured filaments of the invention, the yarns having a denier of 40 or more, a tenacity of about 1.3 grams per denier or more, an elongation of about 8 percent or more, a modulus of about 25 grams per denier or more, and a specific volume in cubic centimeters per gram of one-tenth gram per denier tension of about 1.3 to 3.0. The yarn is further characterized by a laser characterization where the absolute b value is at least 0.25, the absolute a/b value is at least 100, and the L+7 value ranges up to about 75. Some particularly useful yarns have an absolute b value of about 0.6 to about 0.9, an absolute a/b value of about 500 to about 1000, and an L+7 value of 0 to about 10. Other particularly useful yarns have an absolute b value of about 1.3 to about 1.7, an absolute a/b value of about 700 to about 1500 and an L+7 value of 0 to about 5. Other yarns of the invention which are particularly useful have an absolute b value of about 0.3 to about 0.6, an absolute a/b value of about 1500 to about 3000, and an L+7 value of about 25 to about 75 and a Uster evenness of about 6% or less.

For purposes of discussion, the following general definitions will be employed.

By brittle behavior is meant the failure of a material under relatively low strains and/or low stresses. In other words, the "toughness" of the material expressed as the area under the stress-strain curve is relatively low. By the same token, ductile behavior is taken to mean the failure of a material under relatively high strains and/or stresses. In other words, the "toughness" of the material expressed as the area under the stress-strain curve is relatively high.

By fracturable yarn is meant a yarn which at a preselected temperature and when properly processed with respect to frequency and intensity of the energy input will exhibit brittle behavior in some part of the fiber cross-section (wings in particular) such that a preselected level of free protruding broken sections (wings) can be realized. It is within the framework of this general definition that the specific cross-section requirements for providing yarns possessing textile utility is defined.

We believe the following basic ideas play important roles in the yarn-making process.

1. A properly specified cross-section such that the body remains continuous and the wings produce free protruding ends when subjected to preselected processing conditions (WBI $\geqq$ 10).
2. A process in which there is a transfer of energy from a preselected source of a specified frequency range and intensity to fibers of the properly specified cross-section at a specified temperature such that the fiber material behaves in a brittle manner ($0.03 \leqq Bp^* \leqq 0.80$).

Given a properly specified cross-section and a set of process conditions under which the material exhibits brittle behavior, the following sequence of events is believed to occur during the production of desirable yarns of the type disclosed herein.

1. The applied energy and its manner of application generates localized stresses sufficient to initiate cracks near the wing-body intersection. Obviously, low lateral strength helps in this regard.
2. The crack(s) propagates until the wing(s) and body are acting as individual pieces with respect to lateral movement, thus having the ability to entangle with neighbor pieces while still being attached to the body at the end of the crack.
3. Because of the intermingling and entangling, the total forces which may act on any given wing at any instant can be the sum of the forces acting on several fibers. In this manner, the localized stress on a wing can be sufficient to break the wing with assistance from the embrittlement which occurs. We know, for example, that mean stresses generated by the jet are at least one order of magnitude below the stresses required to break individual pieces ($\sim$0.2 G/D vs. $\sim$2 G/D).
4. Finally, it is required that the intensity and effective frequency of the force application and the temperature of the fiber are such that the break in the wing is of a brittle nature, thereby providing free protruding ends of a desirable length and linear frequency as opposed to loops and/or excessively long free protruding ends which would occur if the material behaved in a more ductile manner.

We have found the following parameters to be especially useful in characterizing the process required to obtain a useful yarn with free protruding ends.

$$Bp^* = \frac{\Delta E_a \tau_a}{\Delta E_{na} \tau_{na}}$$

where Bp* is defined as the "brittleness parameter" and is dimensionless;

$\Delta E\tau$ is a product of strain and stress indicative of relative brittleness, where, in particular $\Delta E_{na}$ is the extension to break of the potentially fracturable yarn without the proposed fracturing process being operative;

$\Delta E_a$ is the extension to break of the potentially fracturable yarn with the proposed fracturing process being operative;

$\tau_a$ is the stress at break of the potentially fracturable yarn with the proposed fracturing process being operative;

$\tau_{na}$ is the stress at break of the potentially fracturable yarn without the proposed fracturing process being operative.

The input yarn conditions are constant in the a and na modes.

These parameters are also defined in terms of process conditions. As shown in FIG. 28, the basic experiment involves "stringing up" the yarn between two independently driven rolls as shown with the specific speed of the first or feed roll $V_1$ being preselected. The surface speed of the second or delivery roll $V_2$ is slowly increased until the yarn breaks with $V_2$ and the tension $\tau$ in grams at the break being detected and recorded. This experiment is repeated five times with the proposed fracturing process being operative. In terms of the previously defined variables $$\Delta E_a = \frac{1}{5}\sum_{i=1}^{5}(V_{2ai} - V_1) \quad \text{(meters/min.)}$$

$$\Delta E_{na} = \frac{1}{5}\sum_{i=1}^{5}(V_{2nai} - V_1) \quad \text{(meters/min.)}$$

$$\tau_a = \frac{\left(\frac{1}{5}\sum_{i=1}^{5} g_{ai}\right)\left(\frac{1}{5}\sum_{i=1}^{5} V_{2ai}\right)}{V_1} \quad \text{(gms.)}$$

$$\tau_{na} = \frac{\left(\frac{1}{5}\sum_{i=1}^{5} g_{nai}\right)\left(\frac{1}{5}\sum_{i=1}^{5} V_{2nai}\right)}{V_1} \quad \text{(gms.)}$$

Obviously mechanical damage by dragging over rough surfaces or sharp edges can influence Bp* values. However, for purposes of discussion, the word "process" means the actual part of the fracturing apparatus which is operated to influence fracturing only. In the case of air jets, it is the actual flow of the turbulent fluid with resulting shock waves which is used to fracture the yarn, not the dragging of the yarn over a sharp entrance or exit. Therefore the influence of the turbulently flowing fluid on Bp* is the only relevant parameter, not the mechanical damage. For example, suppose the following measurements were made with $V_1$=200 meters/min.

| | | | | | | |
|---|---|---|---|---|---|---|
| Process Not Operative | $V_{2na}$ | 218 | 219 | 220 | 221 | 222 |
| | $g_{na}$gms. | 200 | 205 | 195 | 200 | 200 |
| Process Operative | $V_{2a}$ | 208 | 208 | 209 | 210 | 210 |
| | $g_a$gms. | 100 | 95 | 105 | 100 | 100 |

For this hypothetical example with the yarn at 23° C.

$\Delta E_a$=9 meters/min.

$\Delta E_{na}$=20 meters/min.

$\tau_a$=(100 gms.) (209 meters/min.)/(200 meters/min.)

$\tau_{na}$=(200 gms.) (220 meters/min.)/(200 meters/min.)

thus $$Bp^* = \frac{(9)\,(100)\,(209)}{(20)\,(200)\,(220)} = 0.21$$

This parameter reflects the complex interactions among the type of energy input (i.e., turbulent fluid jet with associated shock waves), the frequency distribution of the energy input, the intensity of the energy input, the temperature of the yarn at the point of fracture, the residence time within the fracturing process environment, the polymer material from which the yarn is made and its morphology, and possibly even the cross-section shape. Obviously values of Bp* less than one suggest more "brittle" behavior. We have found values of Bp* of about 0.03 to about 0.80 to be particularly useful. Note that it is possible to have a process (usually a fluid jet) operating on a yarn with a specified fiber cross-section of a specified denier/filament made from a specified polymer which behaves in a perfectly acceptable manner with respect to Bp* and by changing only the specified polymer the resulting Bp* will be an unacceptable value reflected in poorly fractured yarn. Thus acceptable Bp* values for various polymers may require significant changes in the frequency and/or intensity of the energy input and/or the temperature of the yarn and/or the residence time of the yarn within the fracturing process.

The preferred range of values of Bp* applies to a single operative process unit such as a single air jet. Obviously cumulative effects are possible and thereby several fracturing process units operating in series, each with a Bp* higher than 0.50 (say 0.50 to 0.80), can be utilized to make the yarn described herein.

Turbulent fluid jets with associated shock waves are particularly useful processes for fracturing the yarns described in this invention. Even though liquids may be used, gases and in particular air, are preferred. The drag forces generated within the jet and the turbulent intermingling of the fibers, characteristics well known in the prior art, are particularly useful in providing a coherent intermingled structure of the fractured yarns of the type disclosed herein.

In Table 1, Runs 1 through 6 show the influence of the fracturing jet pressure on Bp* when using the poly(ethylene terephthalate) feed yarn described in Example 1. Effectively, changing the fracturing jet pressure changes the intensity and the frequency distribution of the energy available for fracturing. Thus Bp* decreases from 0.94 to 0.16 with a corresponding increase in pressure from 100 psig to 500 psig. The quality of the fractured yarns made under these process conditions changes from unacceptable to acceptable in the sense of possessing, desirable textile utility.

Runs 7 through 10 show the influence of residence time of the yarn within the fracturing jet on Bp*, other things being equal. Note that Bp* decreases as residence time increases. The residence time was changed by simply changing the linear throughput speed of the yarn through the jet (400 m/min. to 1000 m/min.).

Runs 11 through 14 show the influence of denier/filament on Bp* with all processing conditions being constant. Note the increase in Bp* with decreasing denier/filament suggesting it is more difficult to properly fracture the yarn as denier/filament decreases. The ability of the yarn bundle to dissipate the energy transferred from the flowing air stream to the yarn is thought to be very important in achieving a desirable product even when desirable cross-section parameters are present. In other words, other things being equal, lower denier/filament manifests itself in larger Bp* values. It is well known that small fibers dissipate energy of the type introduced by the flowing air stream at a faster rate than larger ones. Thus the conditions required to achieve the same level of free protruding ends in yarns with the same number of filaments but which vary only in denier per filament are more severe for the smaller filaments. With the wing-body interaction parameter ≧10, we have made useful yarns from denier/filaments of 1.5 by increasing the air pressure in the fracturing jet or decreasing the temperature of the yarn entering the jet or decreasing the processing speed or combinations of all these.

Runs 15 through 17 show some unexpected differences in polymer type on fracturing behavior with all processing conditions being constant except Run 17, which are more severe. Notice poly(1,4-cyclohexylenedimethylene terephthalate) (Run 15) with a WBI >10 has a Bp* of 0.22 and makes an acceptable textile yarn as does the poly(ethylene terephthalate) sample in Run 16 with a Bp* of 0.29. However poly(butylene terephthalate) under the more severe processing conditions and with a WBI >10 does not exhibit acceptable fracturing behavior. Notice that Bp* is 1.15. We attribute this unobvious behavior to the differences in the frequency and intensity of the energy input and the temperature of the polymeric material required to make the polymer behave in a brittle manner. For example nylon 6, 66 and polypropylene behave in a manner similar to poly(butylene terephthalate). Run 18 shows that by reducing the yarn temperature of poly(butylene terephthalate) as it enters the fracturing jet by running through liquid nitrogen a lower Bp* can be obtained.

Run 19 shows that a low Bp* value must be obtained in conjunction with a WBI ≧10 in order to make a desirable textile yarn.

Runs 19 through 22 show the influence of increasing the fracturing air temperature, other things being constant, on Bp*. Notice as expected the more ductile behavior as the temperature is increased and the correspondingly less desirable textile product.

TABLE 1

Typical Runs Involving Bp*

| Run No. | Yarn | $V_1$ m/m. | $V_{2na}$ m/m. | $V_{2a}$ m/m. | $g_{na}$ gms. | $g_a$ gms. | Nelson* Jet Pressure psig. | Fracture Air Temp. °C. | Bp* | Qualitative Assessment of Free Protruding Ends |
|---|---|---|---|---|---|---|---|---|---|---|
| 1 | Same as | 200 m/min. | 238 m/min. | — | 290 gms. | — | 0 | 25° C. | — | None |
| 2 | Example 1 | 200 m/min. | 238 m/min. | 235 | 290 gms. | 300 | 100 | 25° C. | 0.94 | None |
| 3 | at room | 200 m/min. | 238 m/min. | 231 | 290 gms. | 270 | 200 | 25° C. | 0.74 | Few |
| 4 | tempera- | 200 m/min. | 238 m/min. | 228 | 290 gms. | 305 | 300 | 25° C. | 0.74 | Few |
| 5 | ture | 200 m/min. | 238 m/min. | 217 | 290 gms. | 276 | 400 | 25° C. | 0.39 | Many |
| 6 | | 200 m/min. | 238 m/min. | 211 | 290 gms. | 184 | 500 | 25° C. | 0.16 | Many |
| 7 | Same as | 400 m/min. | 466 m/min. | 426 | 310 gms. | 250 | 500 | 25° C. | 0.29 | Many |
| 8 | Example 1 | 600 m/min. | 685 m/min. | 631 | 310 gms. | 260 | 500 | 25° C. | 0.28 | Many |
| 9 | at room | 800 m/min. | 896 m/min. | 844 | 310 gms. | 270 | 500 | 25° C. | 0.38 | Many |
| 10 | tempera- ture | 1000 m/min. | 1129 m/min. | 1058 | 310 gms. | 280 | 500 | 25° C. | 0.38 | Many |
| 11 | PET 7 D/F WBI = 10 | 400 m/min. | 446 m/min. | 435 | 265 gms. | 255 | 500 | 25° C. | 0.73 | Few |
| 12 | PET 5.5 D/F WBI = 10 | 400 m/min. | 448 m/min. | 435 | 418 gms. | 412 | 500 | 25° C. | 0.72 | Few |
| 13 | PET 3.0 D/F WBI = 10 | 400 m/min. | 446 m/min. | 443 | 402 gms. | 405 | 500 | 25° C. | 0.94 | Very few |
| 14 | PET 1.5 D/F WBI = 10 | 400 m/min. | 423 m/min. | 429 | 324 gms. | 332 | 500 | 25° C. | 1.28 | Very few |
| 15 | Drafted poly(1,4-cyclo-hexylene-dimethylene terephthalate), 165/30, WBI >10, room temperature | 400 m/min. | 488 m/min. | 465 | 206 gms. | 65 | 500 | 28° C. | 0.22 | Many |
| 16 | Drafted PET Same as Example 1 at room temperature | 400 m/min. | 466 m/min. | 426 | 310 gms. | 250 | 500 | 28° C. | 0.29 | Many |
| 17 | Drafted poly-(butylene terephthalate), 165/30, WBI >10, at room temperature | 200 m/min. | 216 m/min. | 216 | 210 gms. | 180 | 500 | 28° C. | 1.15 | None |
| 18 | Same as Run 17 except yarn was cooled by passing through liquid $N_2$ before going to air jet | 200 m/min. | 212 m/min. | 214 | 42 gms. | 25 | 500 | 29° C. | 0.69** | Few |
| 19 | Drafted round cross section, 150/30, PET, | 400 m/min. | 481 m/min. | 463 | 554 gms. | 550 | 500 | 22° C. | 0.74 | None |

TABLE 1-continued

Typical Runs Involving Bp*

| Run No. | Yarn | $V_1$ m/m. | $V_{2na}$ m/m. | $V_{2a}$ m/m. | $g_{na}$ gms. | $g_a$ gms. | Nelson* Jet Pressure psig. | Fracture Air Temp. °C. | Bp* | Qualitative Assessment of Free Protruding Ends |
|---|---|---|---|---|---|---|---|---|---|---|
| | at room temperature | | | | | | | | | |
| 20 | Same as 19 | 400 m/min. | 474 m/min. | 464 | 560 gms. | 560 | 500 | 31° C. | 0.85 | None |
| 21 | Same as 19 | 400 m/min. | 475 m/min. | 464 | 560 gms. | 561 | 500 | 40° C. | 0.84 | None |
| 22 | Same as 19 | 400 m/min. | 470 m/min. | 475 | 540 gms. | 564 | 500 | 49° C. | 1.13 | None |

*Described in this specification.

**The nonoperative condition involved the passing of the yarn through liquid nitrogen without the jet being operative.

To further illustrate the usefulness of Bp* in determining the fracturability of a given filament yarn in a given process the following runs were made.

Polypropylene polymer having an I.V. of 0.75 (0.65–0.80 melt flow blend) was spun at 500 meters/minute at a melt temperature of 240° C. The as-spun denier was 450/30, with a 2-1-3 ⅓-30 type spinneret hole. The filaments were drawn 3.34 X in 135° C. air at 100 meters/minute. The drawn filaments were fractured at 284/250 meters/minutes (14% overfeed) in air using a lofting jet at 175 psig. The filaments had a wing-body interaction of 11 and while passing through the jet had a Bp* of 0.80. Filaments from the same sample were also fractured at 278/250 meters/minute (11% overfeed) in air along with a feed of liquid nitrogen using a lofting jet at 175 psig. The Bp* value with the addition of liquid nitrogen dropped to 0.40, thus aiding in the fracturing of the filaments.

Also a run was made using nylon 66 polymer. Filaments were spun at 625 meters/minute, no heated chimney was used for quenching. The melt temperature was 297° C. The as-spun denier was 500/30, with the spinneret hole type being 2-1-3 ⅓-30. The filaments were drawn 2.5 X at 135° C. The filaments were fractured at 257/249 meters/minute (3% overfeed) in air using a lofting jet at 125 psig. The filaments had a wing-body interaction of 58 and a Bp* of 0.80. Filaments from the same sample were fractured at 257/249 meters/minute (3% overfeed) in air with liquid nitrogen using a lofting jet at 125 psig. The Bp* with the liquid nitrogen was 0.51, thus resulting in a more complete fracture.

Throughout the specification and claims the terms "filaments" and "fibers" will be used interchangeably in their usual and accepted sense.

Procedures and instruments discussed herein are defined below:

Specific Volume

The specific volume of the yarn is determined by winding the yarn at a specified tension (normally 0.1 G/D) into a cylindrical slot of known volume (normally 8.044 $cm^3$). The yarn is wound until the slot is completely filled. The weight of yarn contained in the slot is determined to the nearest 0.1 mg. The specific volume is then defined as $$\text{Specific Volume}_{at\ 0.1\ G/D\ Tension} = \frac{8.044}{\text{wt. of yarn in gms.}}\left(\frac{cc}{gm}\right)$$

Uster Evenness Test (% U)

ASTM Procedure D 1425 - Test for Unevenness of Textile Strands.

Inherent Viscosity

Inherent viscosity of polyester and nylon is determined by measuring the flow time of a solution of known polymer concentration and the flow time of the polymer solvent in a capillary viscometer with an 0.55 mm. capillary and an 0.5 mm. bulb having a flow time of 100±15 seconds and then by calculating the inherent viscosity using the equation $$\text{Inherent Viscosity } (I.V.),\ \eta^{25°}_{0.50\%}\ PTCE = \frac{\ln t_s}{\frac{t_o}{C}}$$

where:

ln=natural logarithm $t_s$=sample flow time $t_o$=solvent blank flow time

C=concentration grams per 100 mm. of solvent

PTCE=60% phenol, 40% tetrachloroethane

Inherent viscosity of polypropylene is determined by ASTM Procedure D 1601.

Laser Characterization

The textile yarn of this invention can be characterized in terms of the hairiness characteristics of the textile yarn. The apparatus used is disclosed in United States Pat. application Ser. No. 762,704, filed Jan. 26, 1977, in the name of Don L. Finley and entitled "Hairiometer". The description is incorporated herein by reference.

For purposes of clarification and explanation, the following symbols are used interchangeably.

B=b $M_T$=A/B=a/b

Throughout this disclosure the terms

Laser absolute value b=laser |b|

Laser absolute value a/b=laser |a/b| will be used also. The words "absolute value" carry the normal mathematical connotation such that Absolute value of (−3)=|−3|=3 or Absolute value of (3)=|3|=3

The number of filaments protruding from the central region of the yarn of this invention can be thought of as the hairiness of the yarn. The words "hairiness", "hairiness characteristics", and words of similar import, mean the nature and extent of the individual filaments that protrude from the central region of the yarn. Thus a yarn with a large number of filaments protruding from the central region would generally be thought of as having high hairiness characteristics and a yarn with a small number of filaments protruding from the central region of the yarn would generally be thought of as having low hairiness characteristics.

A substantially parallel beam of light is positioned so that the beam of light strikes substantially all the filaments protruding from the central region of a running textile yarn. The diffraction pattern created when the beam of light strikes a filament is sensed and counted. The fibers protruding from the central region of the yarn are scanned by the beam of light by incrementally increasing the distance between the running yarn and the axis of the beam of light so that the beam of light strikes a reduced number of filaments after each incremental increase in the distance. The diffraction patterns created when the beam of light strikes a filament are sensed and counted during the scanning. Data on the number of filaments counted at each distance representing the total of the incremental increases and each distance are then collected for typical yarns of this invention. Using the data there is developed a mathematical correlation of the number of filaments counted at each distance representing the total of the incremental increases as a function of a constant value and each distance. Preferably the mathematical correlation is developed by curve fitting an equation to the data points. The hairiness, or free protruding end, characteristics of the yarn are then expressed by mathematical manipulation of the mathematical correlation. A particular yarn to be tested for hairiness is then analyzed in the above-described manner and data representing the number of filaments counted at each distance are collected. The constant value of the mathematical correlation is then determined by correlating with the mathematical correlation, preferably by curve fitting, the collected data representing the number of filaments counted at each distance. The hairiness characteristics of the tested yarn are then determined by evaluating the mathematical expression of the hairiness characteristics of the yarn using the constant value. In addition, the hairiness characteristics of the textile yarn are determined by considering the total number of filaments counted when the beam of light is at longer distances from the yarn.

A particular type of light is used to sense the filaments protruding from the central region of the yarn. Preferably the beam of light is a substantially parallel beam of light and also coherent and monochromatic. Although a laser is preferred, other types of substantially parallel, coherent, monochromatic beams of light obvious to those skilled in the art can be used. The diameter of the beam of light should be small.

In use, a substantially parallel, coherent, monochromatic beam of light is positioned so that the beam of light strikes substantially all the filaments protruding from the central region of a running textile yarn. Preferably the textile yarn is positioned substantially perpendicular to the axis of the beam of light.

As the running yarn translates along its axis, the beam of light sees filaments protruding from the central region of the yarn as the filaments move through the beam of light. Each time the beam of light sees a filament a diffraction pattern is created. During a predetermined interval of time a count of the number of filaments that protrude from the central region of the yarn during the interval of time is obtained by sensing and counting the diffraction patterns. By the term "diffraction pattern" we mean any suitable type of diffraction pattern such as a Fraunhofer or Fourier diffraction pattern. Preferably a Fraunhofer diffraction pattern is used.

Next the filaments protruding from the central region of the yarn are scanned by incrementally increasing the distance between the running yarn and the axis of the beam of light so that the beam of light strikes a reduced number of filaments after each incremental increase.

During the scanning function, wherein the distance between the yarn and the beam of light is incrementally increased, the number of filaments is sensed and counted by sensing and counting the number of diffraction patterns created as the filaments in the yarn move through the beam of light.

The number of incremental increases that is used can vary widely depending on the wishes of the operator of the device. In some cases only a few incremental increases can be used, while in other cases 15 to 20, or even more, incremental increases can be used. Preferably 15 incremental increases are used. The incremental increases are continued until the longest filaments are no longer seen by the beam of light and consequently there are no filaments counted.

In order to insure that a statistically valid filament count is obtained at the initial position and after each incremental increase in distance, the sequence of sensing, counting and incrementally increasing the distance is repeated a number of times and the filament count at each distance averaged. Although the number of times can vary, 8 is a satisfactory number. Thus each of the 16 filament counts would be the average of 8 testing cycles.

Next typical yarns are tested and the average number of filaments counted at each distance is recorded.

The data for the number of filaments counted at each distance representing the total of the incremental increases, N, are mathematically correlated as a function of a constant value and each distance, x. This mathematical correlation can be generally written as $N=f(K,x)$, where N is the number of filaments counted, K is a constant value, and x is each distance. Although a wide variety of means can be used to correlate the N and x data, we prefer that the data are plotted on a coordinate system wherein the values of N are plotted on the positive y axis and the values of x are plotted on the positive x axis. The character of these data can be more fully appreciated by referring to FIG. 21.

In FIG. 21 there are shown various curves representing the relationship between the number of filaments counted, N, and the distance x.

As will be appreciated from a consideration of the nature of the number of filaments counted as a function of the distance from the central region of the yarn, the largest number of filaments would be counted at the closer distances to the yarn, and the number of filaments counted would decrease as the beam of light moves away from the yarn during the scanning. Thus in FIG. 21, when the log of the number of filaments, N, is plotted versus the distance, x, the data are typically represented by a substantially straight line, A. Although the particular mathematical correlation that can be used can vary widely depending on the precision that is required, the availability of data processing equipment, the type of yarn being tested, and the like, a mathematical correlation that gives results of entirely suitable accuracy for many textile yarns is $N=Ae^{-Bx}$, where N is the number of filaments counted at each distance, A is a constant, e is 2.71828, B is a constant, and x is each distance. This relationship is shown as curve A in FIG. 21. Although this relationship gives entirely satisfactory results for most typical yarns, many other correlations can be used for yarns of a particular character. For example if the filaments protruding from the central region of a yarn are substantially the same length and uniformly distributed, much as in a pipe cleaner, then there would be greater number of filaments counted at the closer distances and the number of filaments counted would diminish rapidly at some distance. This relationship could be expressed by a curve much like curve B in FIG. 21. Also for example, if the N and x data were from a yarn with only a few short filaments protruding from the central region, such as angora yarn, the N versus x data could be represented by curve C wherein a few filaments are counted at closer distances and the number of filaments decreases rapidly as the distance is increased. Although the correlation $N=Ae^{-Bx}$ gives good results for typical yarns, greater accuracy can be obtained using the correlation $N=Ae^{-(Bx+Cx2)}$. The correlation $N=Ae^{-(Bx+Cx2)}$ gives good fits to all curves A, B and C. As will be appreciated, there is an infinite number of correlations that can be used to express the relationship between N and x, both for most typical yarns, and for any particular type of yarn.

Since the general mathematical correlation $N=f(K,x)$ represents the relationship between the N and x data, useful information regarding the hairiness characteristics of the yarn can be mathematically expressed by use of the mathematical correlation. For example the area under the curve of the equation is reflective of the amount of hairiness of the yarn, or the total mass of filaments protruding from the central region of the yarn, $M_T$, and can be generally represented as $$M_T = \int_O^\infty f(K,x)dx$$

where B and C are greater than 0. Another hairiness characteristic that can be mathematically expressed by manipulation of the mathematical correlation is the slope of the curve of the equation $N=f(K,x)$. The slope of the mathematical correlation, represented as $$\frac{d[N = f(K,x)]}{dx},$$

is a measure of the general character of the yarn. Thus if the number of filaments, N, is fairly uniform at shorter distances but rapidly decreases at longer distances, the N versus x curve would be somewhat like curve B in FIG. 21. If the number of filaments, N, decreases radically at shorter distances, the N versus x curve might be somewhat like curve C in FIG. 21. The slope of these curves would, of course, be different and would represent yarns with radically different hairiness characteristics.

In addition the hairiness characteristics of the yarn can be expressed as the total number of filaments counted when the beam of light is located at the larger distances from the yarn. For example when 16 distances are used in a preferred embodiment, the sum of the filaments counted at distances 7 through 16 can be used as one hairiness characteristic of the yarn, hereinafter called "laser L+7".

Consideration will now be given to the various hairiness characteristics using the preferred mathematical correlation, $N=Ae^{-Bx}$. The total mass of filaments protruding from the central region of the yarn, $M_T$, is $$M_T = \int_o^\infty Ae^{-Bx}dx$$

where B and C are greater than 0, which can be resolved to $$M_T = \frac{A}{B}$$

The slope of the curve $N=Ae^{Bx}$ can be shown to the B.

Next, the constant values for the mathematical correlation selected for use are determined by testing a particular yarn for hairiness characteristics by repeating the previously described procedure. First the yarn is positioned so that the beam of light strikes substantially all the filaments protruding from the central region of the yarn without striking the central region of the yarn and the number of filaments in the path of the beam of light is sensed and counted. Then yarn is scanned by incrementally increasing the distance between the running yarn and the axis of the beam of light so that the beam of light strikes a reduced number of filaments after each incremental increase in the distance. The number of filaments in the path of the beam of light is sensed and counted after each incremental increase. The procedure is repeated a number of times and a statistically valid average value of the number of filaments counted at each distance is determined.

The average values of the number of filaments counted at each distance, N, and the distances, x, are then used to determine the constant value in the mathematical correlation by correlating, with the mathematical correlation, the number of filaments counted at each distance, N, and the distance, x. Preferably the correlation is accomplished by conventional curve fitting procedures such as the method of least squares. Thus, since it is known from previous work that the relationship between the number of filaments counted at each distance and each distance can be expressed as some specific expression of the general relationship $N=f(K,x)$, the value of K can be determined by correlating the N and x data obtained with the equation $N=f(K,x)$.

Once the value of K is determined, the hairiness characteristics of the yarn can be determined by using the determined value of K and performing the required mathematics to solve whatever hairiness characteristics equation has been developed. For example if the mathematical correlation to be used is $N=Ae^{-Bx}$, then the various values of N and x obtained from testing a particular yarn can be used to determine values of A and B using conventional correlation techniques such as curve fitting using the method of least squares. Once A and B have been determined, the hairiness characteristic, $M_T$, and the slope of the mathematical correlation can be readily determined.

As will be appreciated by those skilled in the art, the function of determining the constant in the mathematical correlation and performing the mathematics to determine any particular hairiness characteristics can be accomplished either manually or through the use of conventional data processing equipment. For example the N and x values can be recorded on a punched tape and the punched tape can be used as the input to a digital computer which is programmed to mathematically express the hairiness characteristics of the yarn, $M_T$, by use of the mathematical correlation $N=Ae^{Bx}$. Then the constant values A and B are determined by the computer by curve fitting the number of filaments counted at each distance, N, and the distance, x, with the mathematical correlation $N=Ae^{Bx}$, using the method of least squares. Finally the computer evaluates the mathematical expression of the hairiness characteristics of the yarn, $M_T$, by dividing B into A.

The present invention will be more fully understood by reference to the following detailed description and the accompanying drawings in which:

In The Drawings

Figure 1:
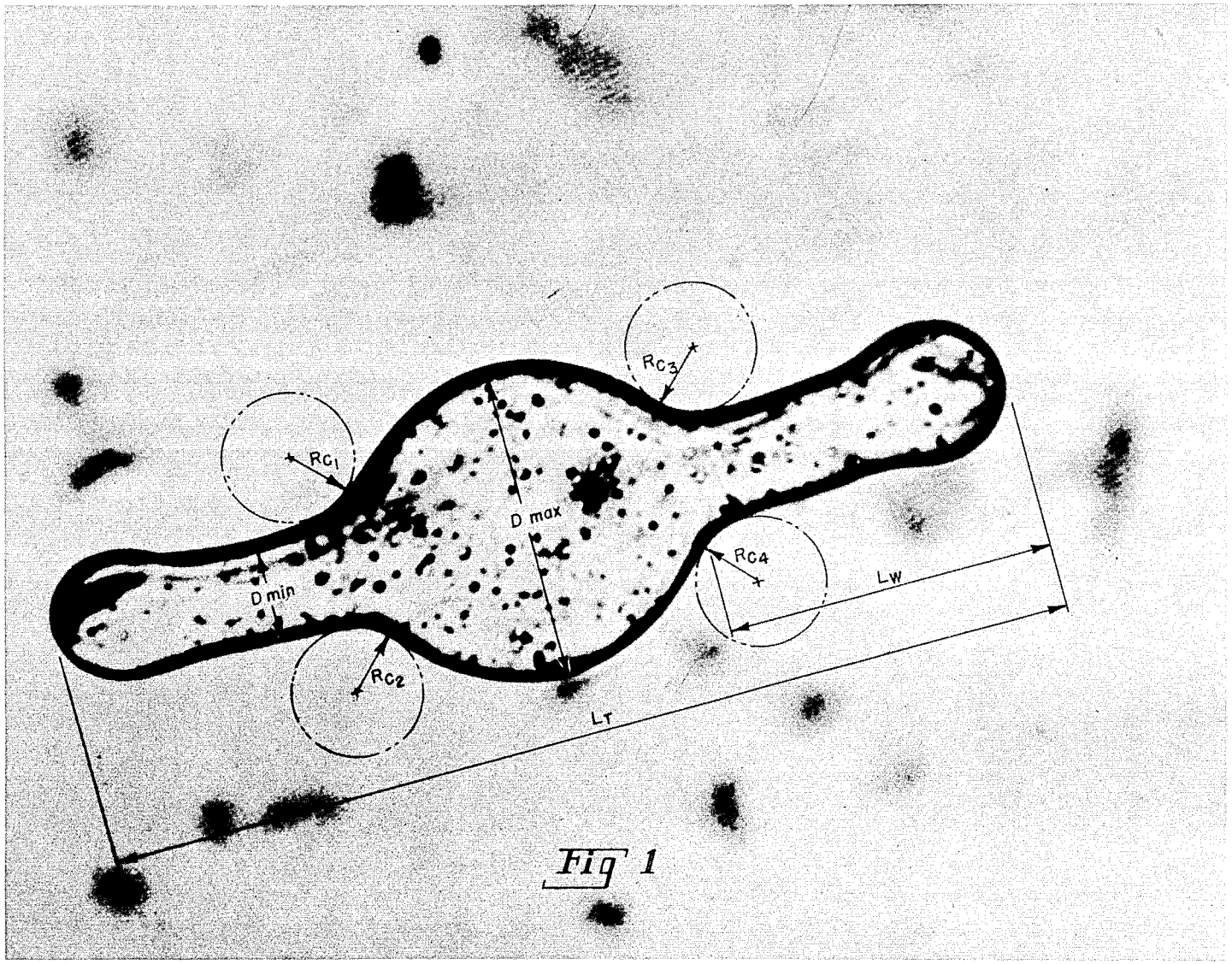
FIG. 1 is a photomicrograph of an individual filament of this invention having illustrated thereon the positioning of measuring instruments for determining the radius of curvature at the body-wing interaction and the diameter of thickness of the body and of the wings.
Figure 2A:
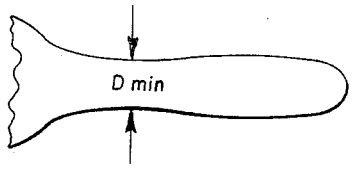
FIGS. 2A, 2B, 2C and 2D are sketches showing where on the wing the thickness (Dmin) of wings of different configurations should be measured.
Figure 2B:
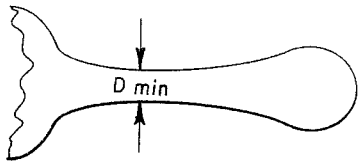
Figure 2C:
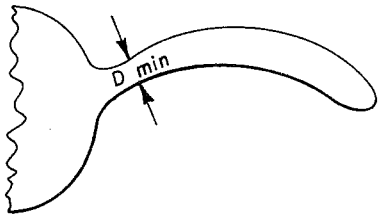
Figure 2D:
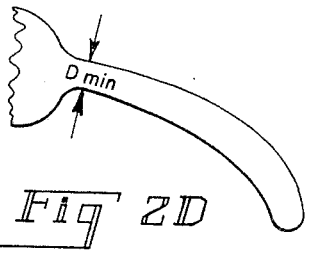
Figure 3A:
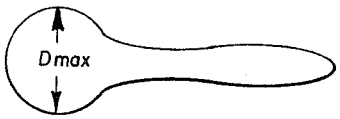
FIGS. 3A, 3B, 3C and 3D are sketches showing where on the body of filaments of different cross-section the filament body diameter (Dmax) is measured.
Figure 3B:
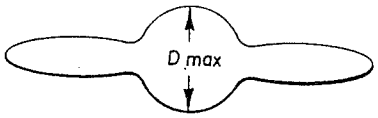
Figure 3C:
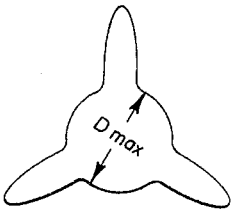
Figure 3D:
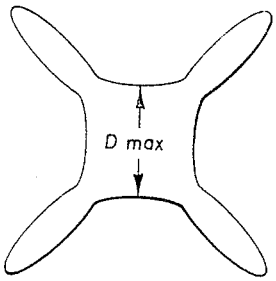
Figure 4A:
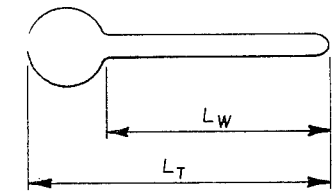
FIGS. 4A, 4B, 4C and 4D are sketches showing where the overall length of a wing cross-section ($L_W$) and the overall or total length of a filament cross-section ($L_T$) is measured.
Figure 4B:
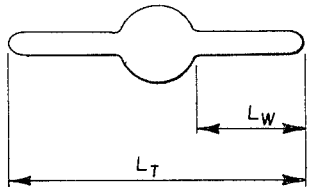
Figure 4C:
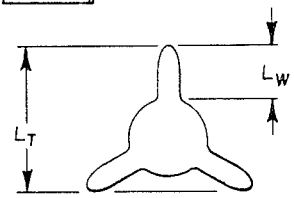
Figure 4D:
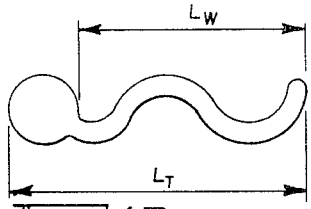
Figure 7:
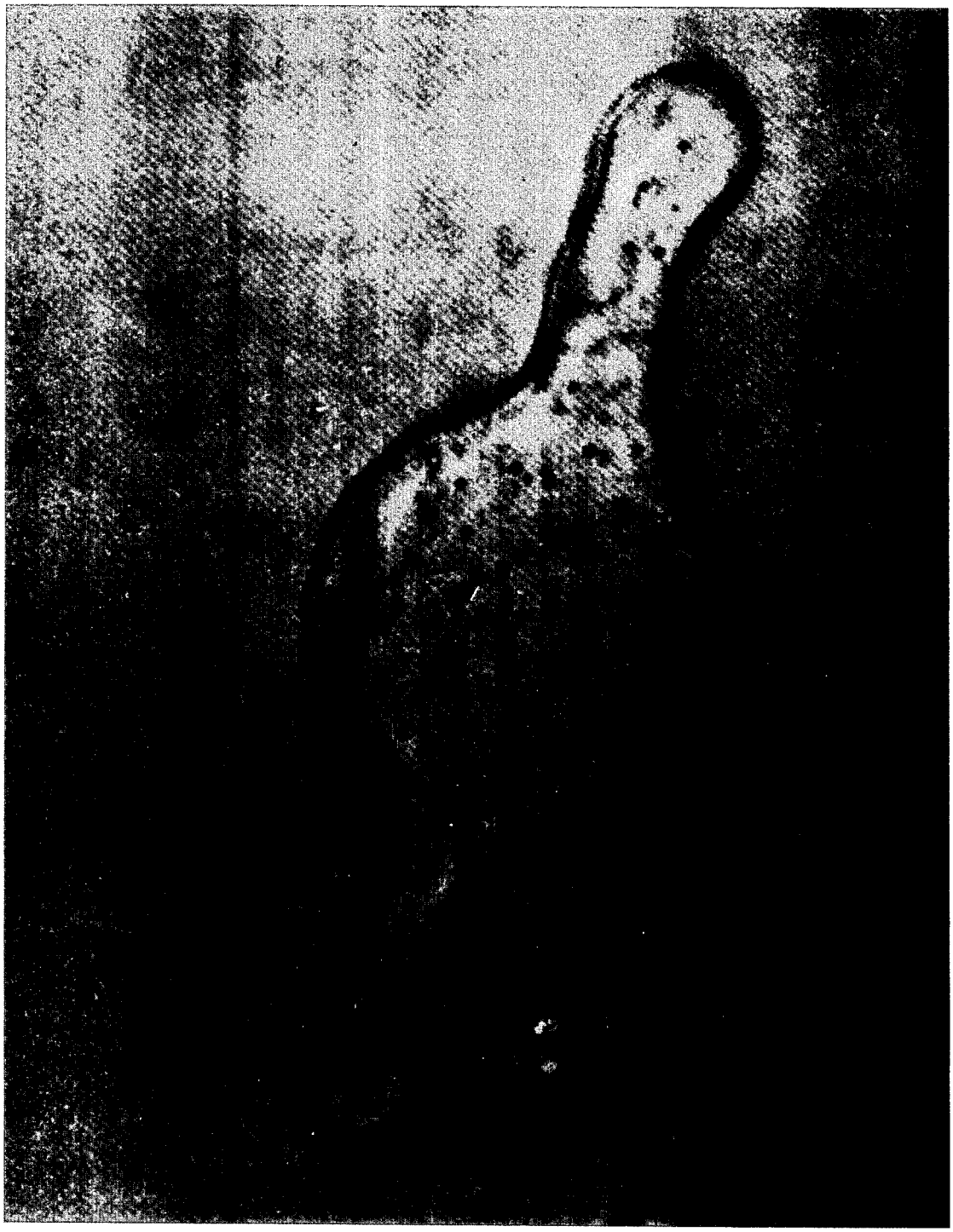
FIG. 7 is a photomicrograph of a filament spun according to the procedure set forth in Example 1 of this specification.

Reference is now made to the drawings in which we show, in FIGS. 1 and 7, photomicrographs of the cross-section of two typical filaments of our invention. It is critical to this invention that the cross-section of the filaments have geometrical features which are characterized by $$\left(\frac{(D\max - D\min)D\min}{2Rc^2}\right)\left(\frac{Lw}{D\min}\right)^2 \geqq 10$$

where the ratio of the width of said fiber to wing thickness ($L_T$/Dmin) is $\leqq 30$. The identification of and procedure for measuring these features is given in detail below. Referring in particular to FIGS. 1–6 of the drawing, we illustrate how the fiber cross-sectional shape characterization is accomplished:

1. Make cross-sectional photographs at 2000× magnification of the undrawn or partially oriented feeder yarns. Focus the microscope until an essentially uniform dark border is obtained while viewing the image, as seen in FIG. 1. It is important to note that drafting of undrawn or partially oriented filaments does not change the shape of the filaments. Thus, except for the inherent difficulties in preserving accurate representations of the fiber cross-section section at 2000× or greater and in cutting fully oriented and heat set fibers, the geometrical characterization can be accomplished using measurements made from photographs of fully oriented and heat set filaments.
2. Measure $D_{min}$, $D_{max}$, $L_W$ and $L_T$ using any convenient scale. These parameters are showin in FIG. 1 and are defined as follows:
   a. $D_{min}$ is the thickness of the wing for essentially uniform wings and the minimum thickness close to the body when the thickness of the wing is variable. FIGS. 2A, 2B, 2C and 2D show some typical examples.
   b. $D_{max}$ is the thickness or diameter of the body of the cross-section. FIGS. 3A, 3B, 3C and 3D show some typical examples.
   c. $L_T$ is the overall length of the cross-section.
   d. $L_W$ is the overall length of an individual wing.

FIGS. 4A, 4B, 4C and 4D show some typical examples. In all cases the above dimensions are measured from the outside of the "black" to the inside of the "white" as shown in FIG. 1. We have found that more reproducible measurements can be obtained using this procedure. The "black" border is caused primarily by the nonperfect cutting of the sections, the nonperfect alignment of the section perpendicular to the viewing direction, and by interference bands at the edge of the filaments. Thus it is important in producing these photographs to be as careful and especially consistent in the photography and measuring of the cross-sections as is practically possible. Average values are obtained on a minimum of 10 filaments.

Figure 5:
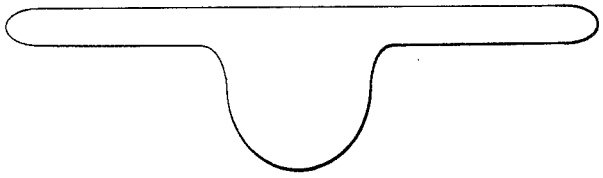
FIG. 5 is a sketch of a filament of this invention showing wings which are essentially tangent to the body.

3. Measure the radius of curvature ($R_C$) of the intersection of the wing and body as shown in FIG. 1. Use the same length units which were used to measure $D_{max}$, $D_{min}$, etc. One convenient way is to use a circle template and match the curvature of the intersection to a particular circle curvature (as shown in FIG. 1). In the case where the extension of the major axis of the wing would pass through the center of the body (i.e., FIG. 1), $R_C$ is measured at the two possible locations per wing for each wing and the sum total of the $R_C$'s is averaged to get a representative $R_C$. For example in FIG. 1 each wing has 2 $R_C$'s yielding a total of 4 $R_C$'s which are averaged to give the final $R_C$. This averaging procedure is also used when there is slight misalignment of the wing and body which can yield substantial differences in the $R_C$'s on opposite sides of a wing. The averaged $R_C$'s for individual filaments are then averaged to get an $R_C$ which is indicative of the filaments in a complete yarn strand. For the cases where the wings are essentially tangent to the body as shown in FIG. 5, only one $R_C$ is obtained per wing. $R_C$ values are usually determined on a minimum of 20 filaments from at least two different cross-section photographs. We have found that the ability of these winged cross-sections to provide a useable raw material for fracturing can be characterized by the following combinations of geometrical parameters.

$$\left(\frac{(D\max - D\min)D\min}{2Rc^2}\right)\left(\frac{Lw}{D\min}\right)^2 \geqq 10$$

where $$\left(\frac{Lw}{D\min}\right)^2$$

is proportional to the stress at the wing-body intersection if the wings were considered as cantilevers only and $$\left(\frac{(D\max - D\min)D\min}{2Rc^2}\right)$$

is proportional to the stress concentration because of retained sharpness of the intersection. For example, see Singer, F. L., *Strength of Materials,* Harper and Brothers, NY, NY, 1951.

Figure 6:
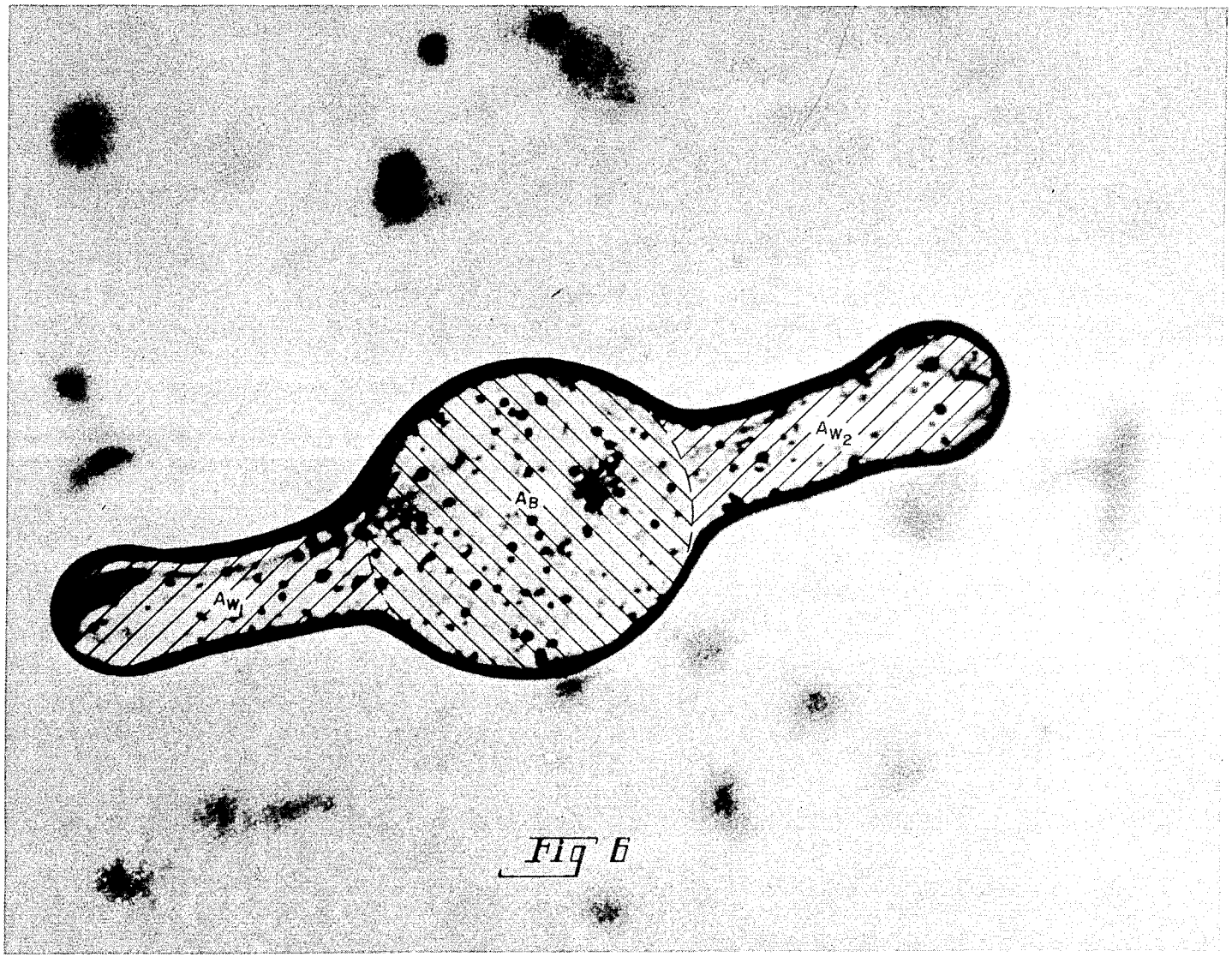
FIG. 6 is a photomicrograph of a filament of this invention showing the lines of demarcation between the cross-sectional areas in the body and wings of a given filament cross-section used to determine the percent body and percent wing of the filament.

4. To determine the percent total mass of the body and of the wing(s), a photocopy of the cross-secton is made on paper with a uniform weight per unit area. The cross-section is cut from the paper using scissors or a razor blade and then the wings are cut from the body along the dotted lines as shown in FIG. 6. A minimum of 20 individually similar cross-sections from at least two different cross-sections are photographed and cut with the total number of bodies being weighed collectively and the total number of wings being weighed collectively to the nearest 0.1 mg. The percent area in the wings and body are defined as $$\%\ \text{Cross-Sectional Area in Wings} = \frac{\text{Collective weight of wings (gms.)}}{\text{Collective weight of wings and bodies (gms.)}}$$

$$\%\ \text{Cross-Sectional Area in Body} = \frac{\text{Collective weight of body (gms.)}}{\text{Collective weight of wings and bodies (gms.)}}$$

The photomicrograph of the filament cross-section shown in FIG. 7 is that of a filament having the necessary geometrical features which will result in the filament fracturing under the conditions set forth herein. The specific filament shown is that which was spun as set forth in Example 1. The spinneret used was that spinneret illustrated in FIG. 8. The spinneret used was 69 mm. in diameter across the face thereof. The orifices are arranged in three concentric circles about the center of the spinneret and are each oriented in a generally parallel pattern; that is, the longest axis of the cross-sections, including wings, are in parallel alignment. The orifices are arranged with fifteen orifices being equally spaced around the perimeter of a circle having a diameter of 53.17 mm.; ten orifices equally spaced around the perimeter of a second circle having a diameter of 36.91 mm.; and five orifices equally spaced around the perimeter of a third concentric circle having a diameter of 19.05 mm. The center of each of the above-mentioned circles is the center of the spinneret face.

Figure 8:
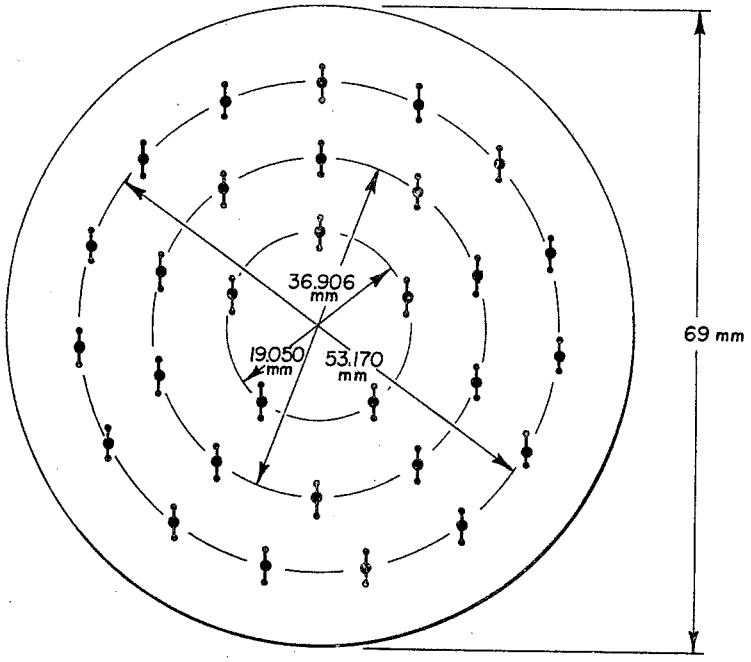
FIG. 8 is a plan view in diagrammatic form of the spinneret used to spin the filament shown in FIG. 7.
Figure 9:
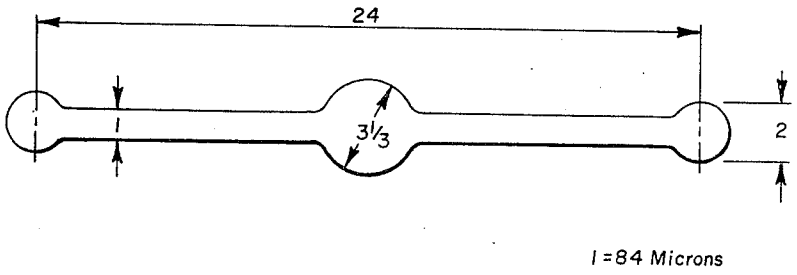
FIG. 9 shows the specific shape and dimensions of the actual orifices in the spinneret illustrated in FIG. 8.
Figure 10:
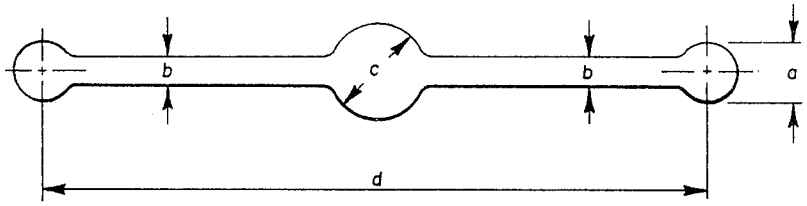
FIGS. 10–14 illustrate various spinneret orifice configurations and relative dimensions useful in the practice of this invention.
Figure 11:
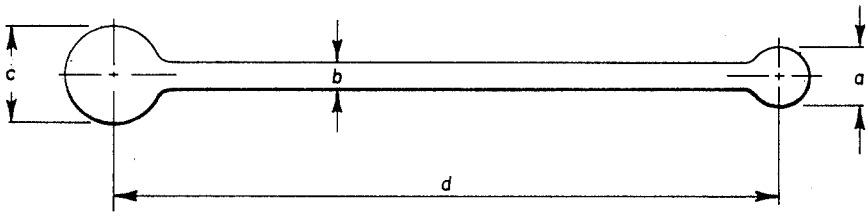
Figure 12:
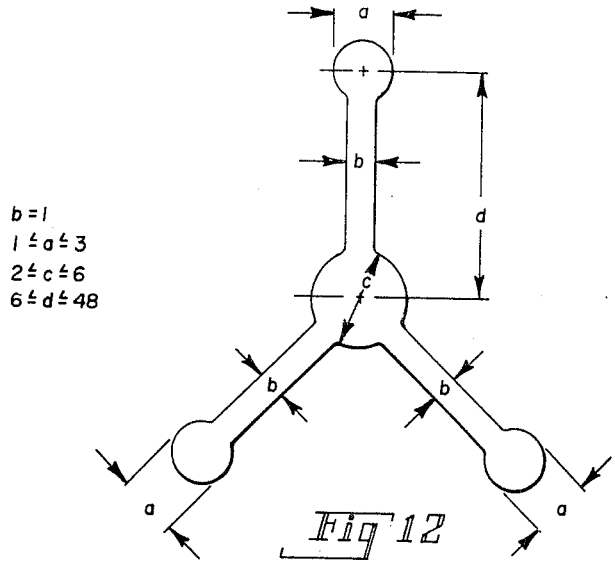
Figure 13:
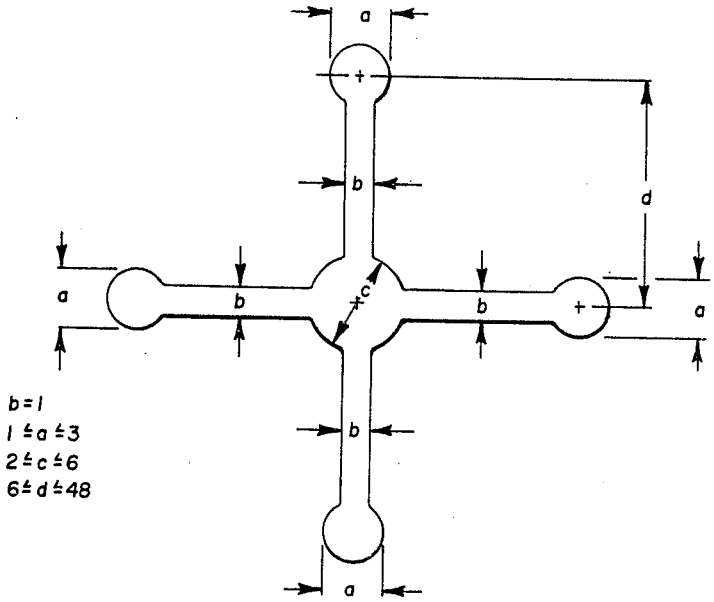
Figure 14:
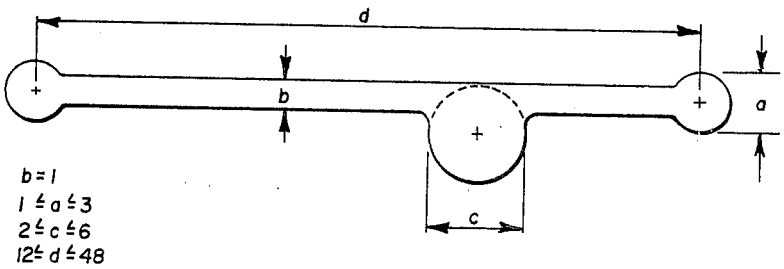

In FIG. 9 we have shown the configuration of the orifice indicated in FIG. 8. In this particular spinneret used to spin the filament shown in FIG. 7, the wing slot was 84 microns in thickness and the remainder of the orifice was dimensioned as follows: the tip of the wing has a bore (a) which is twice as wide as in the wing slot (b); the body bore (c) is $3\frac{1}{3}$ times as wide as is the wing slot (b); and the cross-section length (d) is 24 times as long as the wing slot (b) is wide.

FIGS. 10–14 show different configurations of spinneret orifices which are useful in spinning filaments of this invention. The dimensions of the bores and slots are all normalized to the wing slot dimension b such that b is always 1. The range of each dimension a, c and d as compared with dimension b is indicated on each of FIGS. 10–14. It is recognized that dimension b should be as small as practical consistent with good spinning performance, for example, about 75 to about 150 microns is preferred.

We have found that spinneret orifices which are useful in the practice of this invention comprise at least a primary orifice or bore and at least one connecting slot orifice with the relationship of the dimensions of the spinneret orifice being $b=1$; $a = \geqq 1$ to $\leqq 3$, $c = \geqq 2\frac{1}{3}$ to $\leqq 6$, and $d = \geqq 12$ to $\leqq 48$. Some specific orifices which have the preferred relationship of the dimensions of the orifice are as follows: $a=2$, $b=1$, $c=3\frac{1}{3}$, and $d=24$; $a=1\frac{1}{2}$, $b=1$, $c=2\frac{2}{3}$, and $d=24$; $a=2$, $b=1$, $c=3$ and $d=24$; $a=2$, $b=1$, $c=2\frac{2}{3}$ and $d=24$; $a=2$, $b=1$, $c=3\frac{2}{3}$ and d=24; a=2, b=1, c=4 and d=24; a=b, b=1, c=4⅓ and d=24; a=2, b=1, c=3⅓ and d=30; a=2, b=1, c=3⅓ and d=36; and a=2, b=1, c=3⅓ and d=18.

Figure 15:
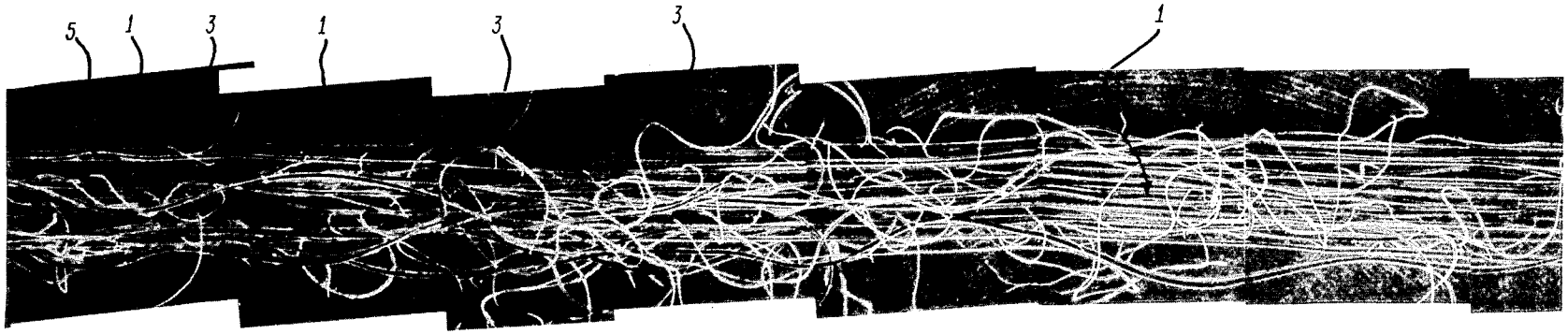
FIG. 15 is a montage of a length of the yarn made according to Example 1.
Figure 20:
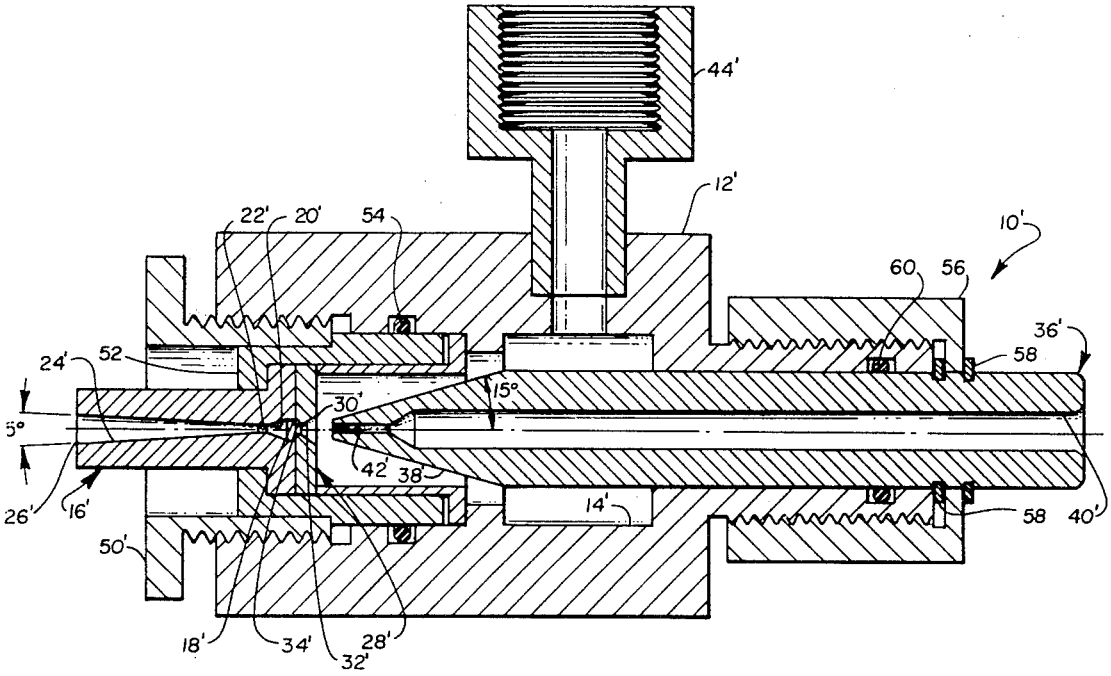
FIG. 20 is a cross-sectional view of a jet useful to fracture the filaments of this invention.
Figure 21:
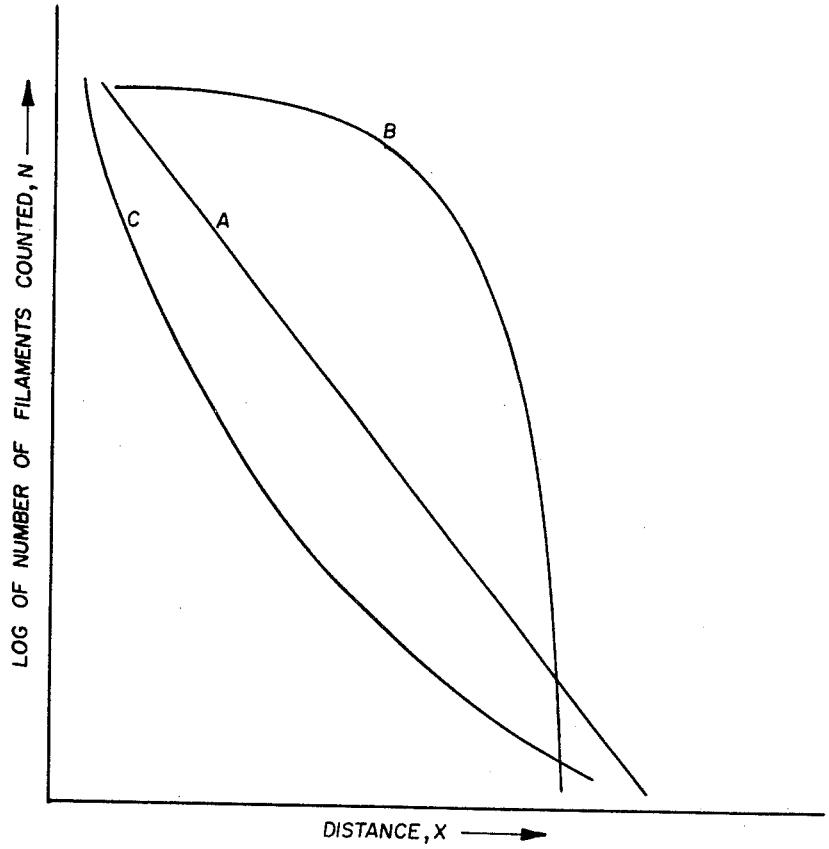
FIG. 21 is a plot of various curves representing the number of filaments protruding from the central region of the yarn versus the distance from the central region of the yarn.

In FIG. 15 we have shown a montage of the yarn made according to Example 1. The yarn is made up of filaments, as shown in FIG. 7, which have been fractured under the conditions set forth in Example 1. This particular yarn has a total denier of 163, with 30 filaments. The remaining properties are set forth in Example 1. It is seen from an inspection of FIG. 15 that the yarn has many free protruding ends distributed along its surface and throughout the yarn bundle. Also the yarn is coherent due to the entangling and intermingling of neighboring fibers. These free protruding ends are formed as the feed yarn is fed through a fracturing jet as is shown in FIG. 20, which is our preferred jet for fracturing, or a jet of the type shown in U.S. Pat. No. 2,924,868, hereinafter referred to as the Dyer jet.

Figure 16:
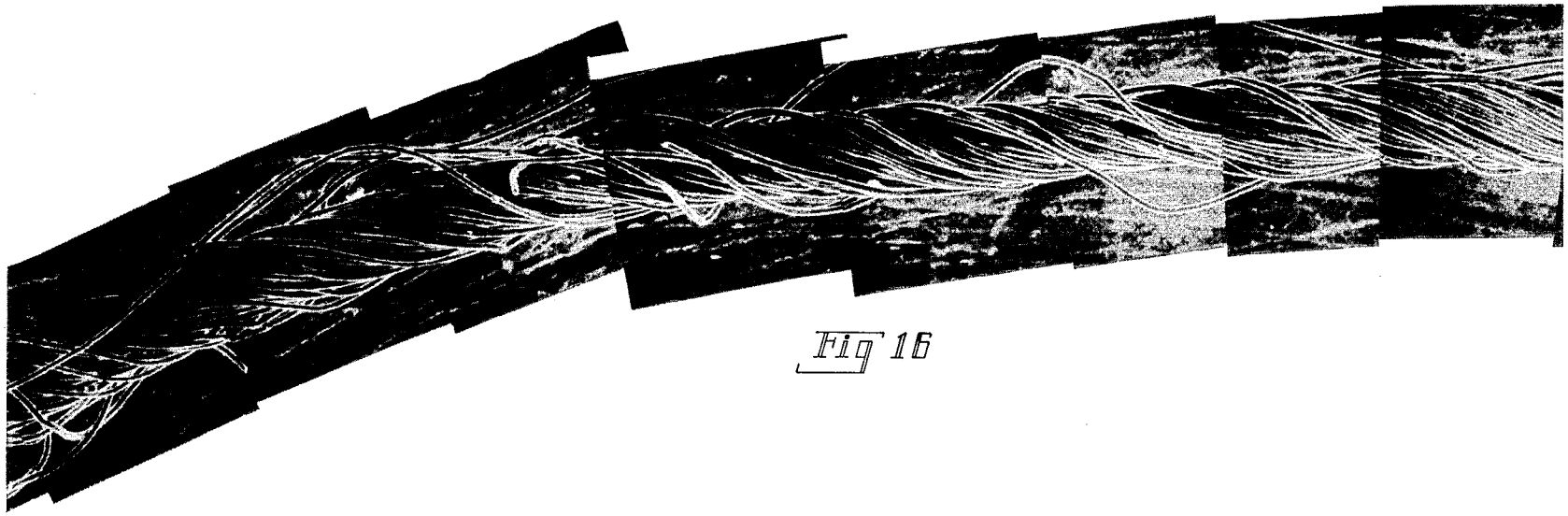
FIG. 16 is a montage of a length of conventional spun yarn of 100% polyester staple fiber.

The basic structure of yarns of this invention is contained within the geometrical character of the single filaments which comprise the yarn of which a typical example is shown in FIG. 16. Several features of these filaments are noted in FIG. 16, namely the bridge loops 1 and the free protruding ends 3.

As described earlier, the process by which this yarn is made initiates a series of cracks which propogate into visible loops, some of which break to provide the free protruding ends. The ones remaining are designated "bridge loops" and always have the unusual feature that the separated wing section is essentially straight and the body section from which it separated is curved. Thus the separated wing section 5 is shorter than the body section from which it separated (see FIG. 16). Also notice in FIG. 16 that there is a preferred direction for the initial separation of the free protruding end from the body of the filaments.

The characterization of the features of these fibers was carried out as follows. Single fibers were separated from the yarns and mounted on microscope slides, several fibers to a slide. A section of each slide approximately 30 mm long was photographed using a microfilm reader/printer at 12.25× magnification. This magnification was selected because total wings are easily visible and the small connecting fibrils which are left after a wing is separated from the body are difficult to see. At this magnification events less than 0.25 mm are not visible. Sufficient photos were made for each sample to permit measurements on at least 150 hairs (and, ideally, 200 or more). The various samples involved from 5 to 19 slides; as few as 20 and as many as 95 separate fiber segments; and 0.6 to 3.0 meters of fiber.

Measurements were made to within 1 mm on the photographs of the length of and distance between all of the hairs and the distance between the bridge loops. The number of hairs measured varied from 115 to 679. Histograms were constructed as follows:

hair length: cell width=1.0 mm on photo, 1st 35* cells hair separation: cell width=0.1 mm actual, 1st 51 cells

* 158-2: 100 cells

** 1st cell only: 0.00–0.05 mm actual

The mean and variance of the distance between hairs were calculated in actual (not magnified) length units.

125× photomicrographs were made of several representative sections of each sample, and the wing width (w) and angle of break ($\theta$) were measured. The angle of break was adequately represented by a log normal distribution for COT$\theta$, and a single set of parameter values ($\mu_2$=3.096, $\sigma_2$=0.450) could be used for all samples. The variation of w within a sample was of the same order as the precision of the measurement, and w could safely be considered constant for a given sample.

The set of equations from which the estimates of the parameters $\alpha$ and $\beta$ were obtained are as follows.

$$f(x) = \frac{H(x)}{\int_0^\infty H(x)dx}$$

$$\eta_H = \frac{S}{Z_o} \cdot \frac{H(x)}{\int_0^\infty H(x)dx} \cdot \Delta X = f(x)\frac{\Delta X \cdot S}{Z_o}$$

$$H(x) = \int_{-x}^{+x} \tfrac{1}{2}\alpha e^{\alpha\left(\frac{x+z}{2}\right) - \beta/\left(\frac{x+z}{2}\right)} R\left(\frac{x-z}{2}\right) dz$$

$$R(\xi) = \frac{1}{\xi\sigma_2\sqrt{2\pi}} \exp\left[-\tfrac{1}{2}\left(\frac{\ln \xi - \ln w - \mu 2}{\sigma_2}\right)^2\right]$$

where $\eta_H$=number of hairs on fiber having length X±ΔX/2 f(x)=the probability density function for the free protruding ends (hairs)

H(x)=the distribution function for the lengths of the free protruding ends

R($\xi$)=the log normal distribution with mean $\mu_2$+ln w and variance $\sigma_2^2$ S=total length of fiber in sample $Z_o$=average distance along fiber between hairs ΔX=width of histogram cell $1/\alpha$=average length of cracks originally created in fiber $\beta$=length dependence of crack break probability ($e^{-\beta/x}$)

w=width of wing on fiber $\left.\begin{matrix}\mu 2\\ \sigma 2\end{matrix}\right\}$ = constants defining angle of crack breaking Data inputs to the least squares estimation program for the estimation of the best values of $\alpha$ and $\beta$, in addition to the histogram frequencies for hair length, were: (1) magnification; (2) angle parameters ($\mu_2$, $\sigma_2$); (3) wing width (w); (4) mean distance between hairs ($Z_o$); and (5) total sample length (S).

The outputs of this estimation, in addition to the "best" values of the parameters ($\alpha$,$\beta$), were:

(1) the histogram frequencies predicted from ($\alpha$,$\beta$);

(2) the deviations of predicted from observed frequencies;

(3) the sensivitiy matrix;

(4) the standard error (RMS deviation) of the predictions;

(5) approximate correlation coefficient and confidence intervals of ($\alpha$,$\beta$); and (6) certain other diagnostic parameters and characteristic functions calculated from ($\alpha$,$\beta$).

The results of the least squares fit were used as inputs to a computer program which was written to simulate the complete model by use of a Monte Carlo technique to generate 10,000 events, using exactly the same set of pseudo-random numbers for each sample. The sequence of random numbers used is known to be uniformly distributed. The ratio of the total length of the sample to the simulated length of 10,000 events was used to scale the simulated results so that they might be compared directly to any histograms available from actual measurement. FIGS. 35 through 40 show the results of the simulation with respect to the histogram of the distance between free protruding ends.

Table II and FIGS. 29 through 40 show the complete results on several typical examples.

TABLE II

Summary of Parameters Relating to the Length & Separation Distributions of Bridge Loops & Free Protruding Ends (Hairs) on XNY Fibers

| Sample Reference | 158-2 | D[3] | F | G | I | J |
|---|---|---|---|---|---|---|
| Cross Section | 2-1-3 $\frac{1}{3}$-24 | 2-1-3 $\frac{1}{3}$-24 | 2-1-3 $\frac{1}{2}$-24 | 2-1-3 $\frac{1}{3}$-24 | 2-1-4-24 | 2-1-3 $\frac{1}{3}$-30 |
| Tot. Den./No. Fil. | 170/30 | 170/30 | 170/25 | 170/20 | 170/30 | |
| Speed (m/min.) | 402/400 | 1010/1000 | 1010/1000 | 1010/1000 | 1010/1000 | 1010/1000 |
| Pressure Nelson Jet (psig) | 450 | 500 | 500 | 500 | 500 | 500 |
| Tot. Lg. Sample (mm) | 1202 | 642 | 1613 | 1452 | 817 | 823 |
| Width of Wing (mm) | 0.0115 | 0.0115 | 0.0160 | 0.0173 | 0.0107 | 0.0139 |
| Avg. Dist. Between Hairs (mm) | 1.67 | 2.61 | 4.58 | 6.08 | 2.67 | 3.01 |
| Dist. Between Hairs (St. Dev.) | 1.28 | 2.40 | 4.23 | 5.65 | 2.03 | 2.07 |
| Sep. (mm) of Major Events[1] Avg. | 0.90 | 2.07 | 2.16 | 3.19 | 2.04 | 2.22 |
| Sep. (mm) Bridge Loops[2] Avg. | — | 9.90 | 4.10 | 6.70 | 8.60 | 8.40 |
| Lg. (mm) Hairs Avg. | 1.49 | 1.66 | 2.08 | 6.18 | 2.24 | 1.47 |
| Lg. (mm) Hairs (St. Dev.) | 0.84 | 1.27 | 1.71 | 5.82 | 1.54 | 1.01 |
| Lg. (mm) Major Events[1] Avg. | 1.13 | 1.61 | 2.08 | 6.18 | 1.86 | 1.41 |
| Lg. (mm) Bridge Loops[2] Avg. | 0.72 | 0.63 | 0.61 | 1.64 | 1.37 | 0.55 |
| $\alpha$ ($mm^{-1}$) | 1.357 | 0.812 | 0.592 | 0.174 | 0.706 | 1.040 |
| $\beta$ (mm) | 0.469 | 0.0564 | $1.84 \times 10^{-5}$ | $3.33 \times 10^{-6}$ | 0.420 | 0.0813 |
| 95% Conf. Limit ($\pm$) $\alpha$ | 0.166 | 0.173 | 0.139 | 0.0605 | 0.158 | 0.236 |
| 95% Conf. Limit ($\pm$) $\beta$ | 0.118 | 0.063 | 0.032 | 0.0634 | 0.217 | 0.0795 |
| Specific Volume cc./gm. | 2.50 | 1.70 | — | — | — | — |

[1]Protruding ends (hairs) + bridge loops >0.25 mm long
[2]Bridge loops >0.25 mm long
[3]Sample D used the same source yarn as Example 1 but was fractured at 1000 m/min.

The preferred fracturing jet design is a jet using high pressure gaseous fluid to fracture the wings from the filament body and to entangle the filaments making up the yarn bundle as well as distributing uniformly the protruding ends formed by the fracturing operation throughout the yarn bundle and along the surface of the yarn bundle. The yarn is usually overfed slightly through the jet from 0.01% to 5% with 0.5% being expecially desirable.

A particularly useful fracturing jet (herein called the Nelson jet) is that disclosed in United States Patent Application Ser. No. 762,614, filed Jan. 26, 1977, in the name of Jackson L. Nelson, and entitled "Yarn Fracturing and Entangling Jet". The description is incorporated herein by reference. In FIG. 20 there is shown a cross-sectional view in elevation of this jet which we prefer for the fracturing of our novel filaments. This jet comprises an elongated housing 12' capable of withstanding pressures of 300–500 psig., the housing is provided with a central bore 14', which also defines in part a plenum chamber for receiving therein a gaseous fluid. A venturi 16' is supported in the central bore in the exit end of the housing and has a passageway extending through the venturi with a central entry opening 18', a converging wall portion 20', a constant diametered throat 22' with a length nearly the same as the diameter, a diverging wall portion 24' and a central exit opening 26'.

An orifice plate 28' is supported in the central bore and abuts against the inner end of the venturi in the manner shown. The orifice plate has a central opening 30' which is concentric with the central entry opening of the venturi, and the wall 32' of the entry opening has an inwardly tapering bevel terminating in an exit opening 34'. A yarn guiding needle 36' is also positioned in the central bore of the housing and has an inner end portion 38' spaced closely adjacent the central entry opening of the orifice plate. The needle has an axial yarn guiding passageway 40', which extends through the needle and terminates in an exit opening 42'. The outer wall of the inner end portion of the needle adjacent the exit opening is inwardly tapered toward the orifice plate in the manner shown. An inlet or conduit 44' serves to introduce the gaseous treating fluid, such as air, into the plenum chamber of the central bore 14' of the housing 12'.

The inward taper of the outer wall of the needle inner end portion 38' is about 15° relative to the axis of the axial yarn guiding passageway 40'. The needle exit opening has a diameter of about 0.025 inch. The wall of the central entry opening 30' of the orifice plate 28' has an inwardly tapering bevel of about 30° relative to the axis of the entry opening 32', the exit opening 34' has a diameter of about 0.031 inch, and the length of such exit opening is about 0.010 inch. The thickness of the orifice plate is about 0.063 inch.

The constant diametered throat 22' of the venturi 16' extends inwardly from the central entry opening 18' by a distance of about 0.094 inch; the throat has a length of about 0.031 inch and a diameter of about 0.033 inch. The converging wall portion 20' of the venturi has an angle of about 17.5° relative to the axis of the central entry opening of the venturi and the venturi central entry opening has a diameter of about 0.062 inch.

A holder 52 aids in holding the venturi in position in addition to the corresponding use of the threaded plug 50' while an O-ring 54 provides a gas-tight seal in a known manner with the holder to prevent gas from escaping from the plenum chamber.

The yarn guiding needle 36' is adjustably spaced within the central bore 14' from the orifice plate 28' by means of the threaded member 56. The needle is secured to the threaded member by means of cooperating grooves and retaining rings 58. O-ring 60 serves as a gas seal in known manner. Rotation of the threaded member 56 serves to adjust the spacing of the needle relative to the orifice plate 28'.

In using the jet it is adjusted to give a blow back of 2 psig. as determined by the following procedure. A constant 20 psig. air source is attached to the air inlet of the jet by a rubber hose. The yarn inlet of the jet is pressed and sealed against a pressure gauge. The threaded member 56 is adjusted until 2 psig. is obtained on the pressure gauge. This jet is said to be adjusted to a blow back of 2 psig.

In FIG. 16 we have shown a montage of a conventional spun yarn made of 100% polyester (PET) staple fiber. The fibers in this yarn have a staple length of about 1½ inch and a denier per filament of about 1.5. The yarn is a 36/1 cotton count or about 146 denier. The specific volume of this yarn was 1.77 cc./gm. with the laser absolute b value equal to 0.72, laser absolute a/b value equal to 709, and laser L+7 equal to 6. Very little variation is possible in the laser properties of a given size staple yarn, whereas the specific volume can be changed by changing the twist level. A comparison of a yarn of this invention and a conventional spun yarn, both being made from 100% polyester, gives an indication of the reason for the soft and pleasing hand of our yarn as compared to conventional spun polyester staple yarns. Note the relatively few protruding free ends in the conventional yarn as compared to this particular yarn of the invention.

Figure 17:
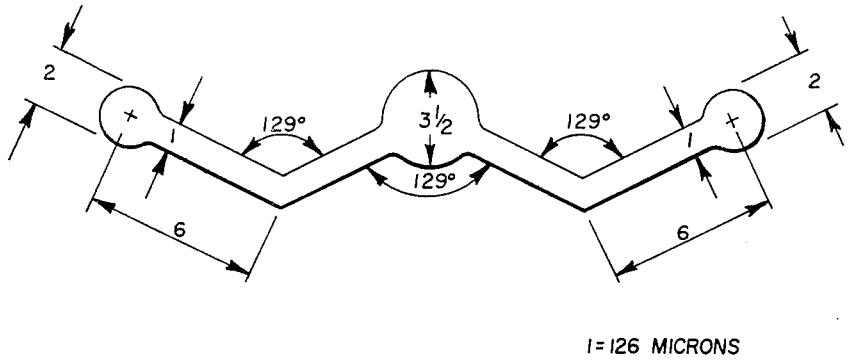
FIG. 17 shows a spinneret hole which can be used to make an acceptable feed yarn for the fracturing process.

In FIG. 17 we have shown a spinneret orifice which can be used in spinning an acceptable fracturable feed yarn of this invention. It is effectively a 129° "W" cross-section with bores in center and at the ends of wings. This illustrates the fact that the wings do not have to be straight. This particular spinneret orifice was used to spin the feeder yarn characterized in Example 13. The orifice dimensions used are shown in the drawing.

Figure 18:
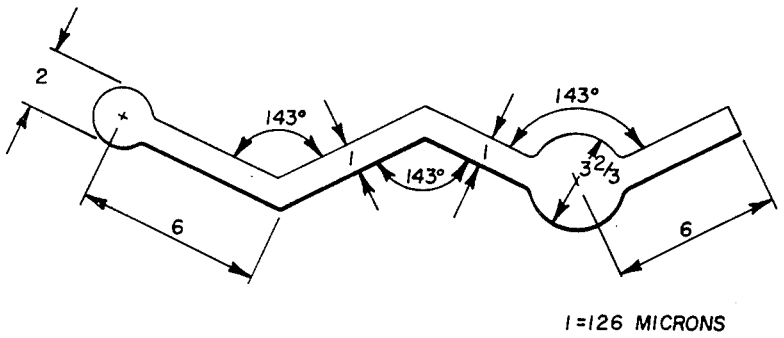
FIG. 18 shows a spinneret hole which can be used to make an acceptable feed yarn for the fracturing process.

In FIG. 18 we show a spinneret hole which can be used in spinning an acceptable fracturable feeder yarn of this invention. The orifice is effectively a 143° "W" cross-section with a bore at one end and a second bore at an opposite vertex. This type spinneret orifice yields two different types and lengths of wings and is not symmetrical. This particular spinneret orifice was used to spin the feeder yarn characterized in Example 14. The orifice dimensions used are shown in FIG. 18.

Figure 19:
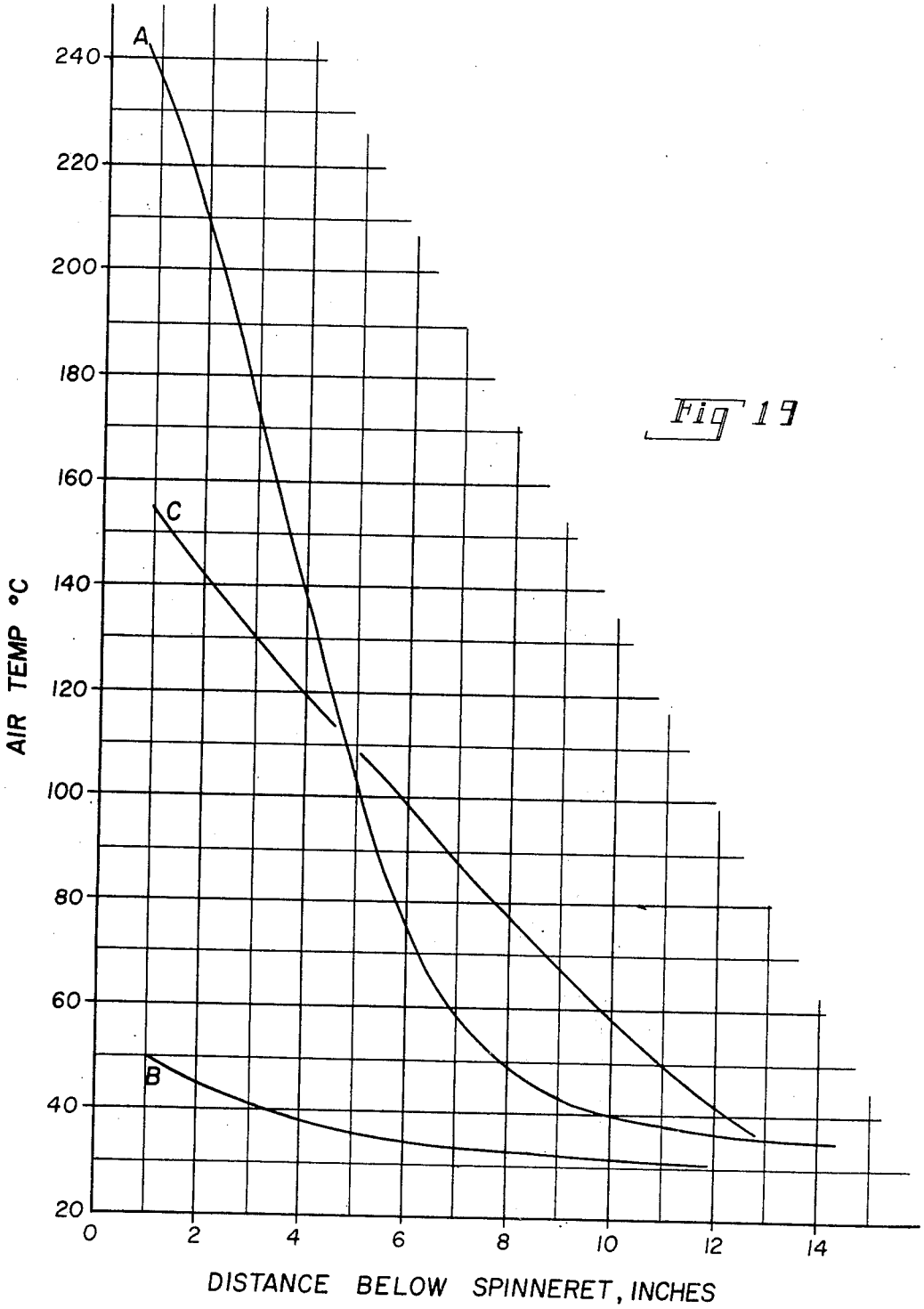
FIG. 19 is a graph showing the temperature profile of the quenching systems of Examples 1, 2 and 3.

FIG. 19 shows the temperature profiles of the air measured adjacent to the spinning thread line starting essentially at the face of the spinneret for the different spinning arrangements set forth in Examples 1, 2 and 3. Curve A is the profile for the system disclosed in Example 1. Curve B is the profile for the system used in Example 2, and Curve C is the profile for the system used in Example 3. In Example 3 we have added as equipment to that used in Example 2 only a protective and electrically heated shield approximately 12 inches in length. It is placed beneath the spinneret in the system described in Example 2 to maintain the air temperature one inch below the spinneret at approximately 150° C. It is quite surprising that the shape of the cross-section of filaments spun with temperature profile A and the equipment disclosed in Example 1 and temperature profile B and the equipment disclosed in Example 2 are very useful and desirable whereas the shape of the cross-section of filaments spun with the equipment disclosed in Example 3 with the shield yielding the temperature profile C are of very poor quality in a fracturability sense. The reason for this difference is not known.

Figure 22:
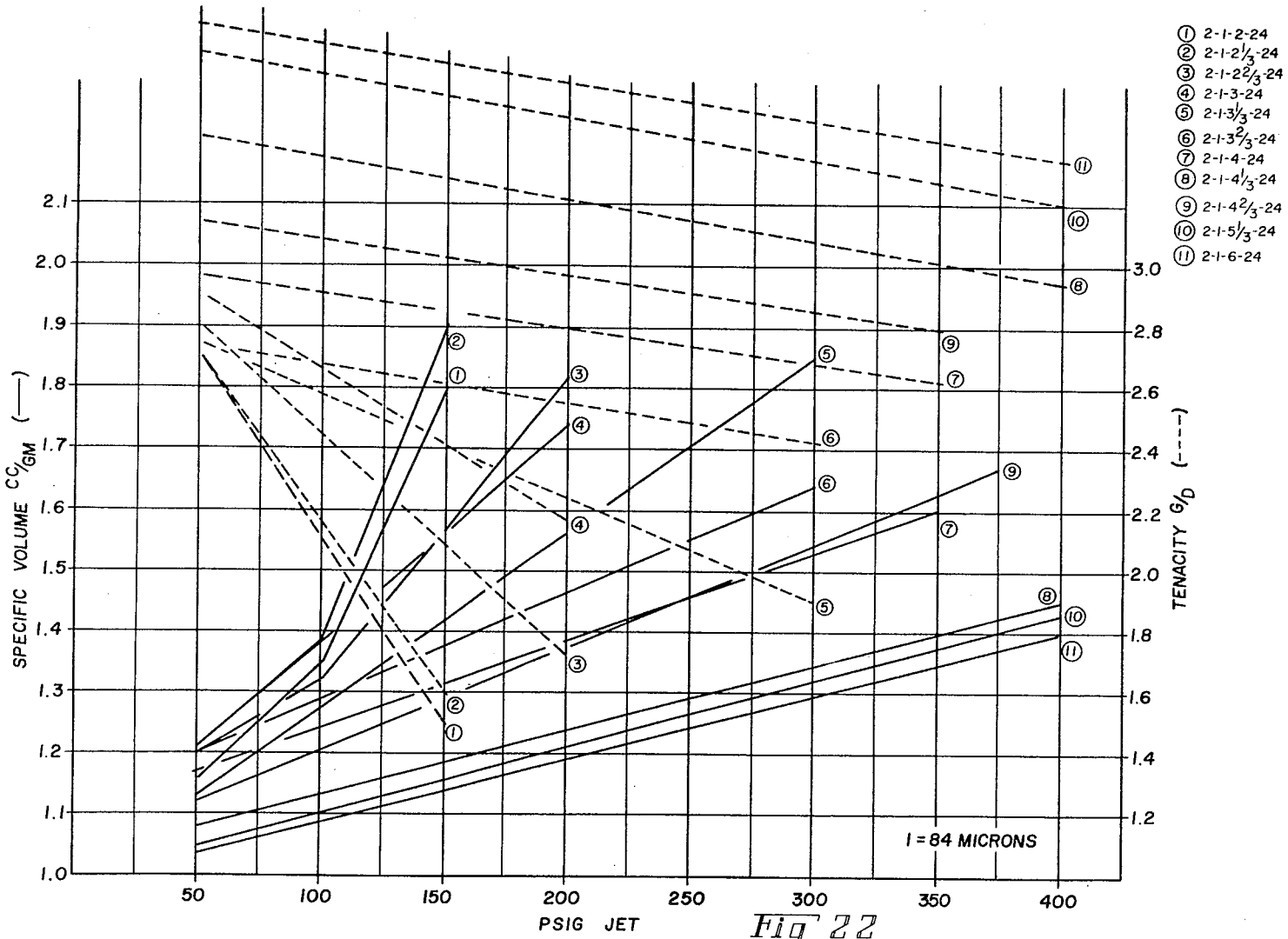
FIG. 22 is a graph showing the influence of the center hole size in spinneret orifices on yarn tenacity and yarn specific volume as a function of fracturing jet air pressure.

FIGS. 22, 23, 24, 25, 26 and 27 show the versatility of yarns made in accordance with this invention, in particular showing the fractured yarn tenacity (G/D) and yarn specific volume (cc./gm.) being plotted as a function of the air pressure in a Dyer type jet. In addition FIG. 22 shows the influence which dimension c (see FIG. 10) has on the above-mentioned parameters. Notice that in general an increase in c (other geometrical parameters remaining constant) yields an increase in yarn strength and a decrease in specific volume when fractured at a constant pressure. It is also quite surprising that for c greater than 3, the tenacity versus fracturing pressure curves are essentially parallel with only an increasing level of tenacity with increasing c apparent at any pressure.

All of the yarns whose properties are shown in FIG. 22 were 120/30 denier/filament yarns. An inherent characteristic of yarns of this invention is that as the denier per filament of the individual filament increases, the specific volume of fractured yarn increases under the same process conditions. Typically a desirable 120/30 yarn will have a specific volume of 1.75 cc./gm. whereas a 165/30 yarn spun and processed under identical conditions will yield a specific volume about 0.2 to about 0.3 specific volume units higher or about 2.00 cc./gm. As another example, a 150/20 yarn will yield a specific volume about 0.1 to about 0.2 specific volume units higher than a 150/30 yarn processed under the same conditions. Thus if FIG. 22 had been constructed using 165/30 yarns the specific volume curves would all be shifted upward.

Figure 23:
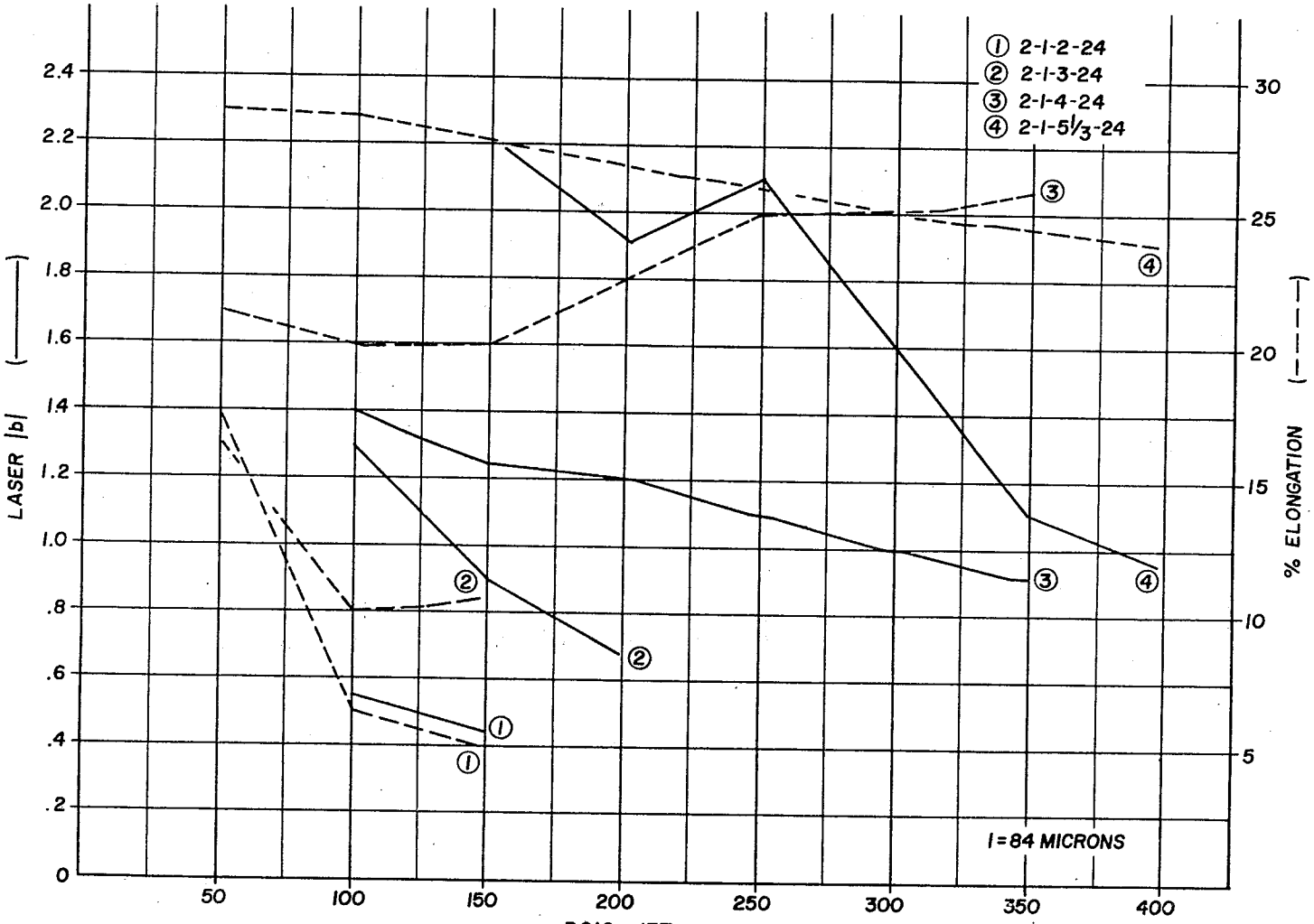
FIG. 23 is a graph showing the influence of center hole size in spineret orifices and fracturing jet air pressure on laser absolute b values and percent elongation in fractured yarns.

FIG. 23 shows the influence of fracturing jet air pressure and spinneret dimension c on laser absolute b value and on percent elongation of the fractured yarn. Note the surprising magnitude of the increase in elongation of the fractured yarn with increasing c as well as the decrease in b with increasing fracturing jet air pressure for any c value.

Figure 24:
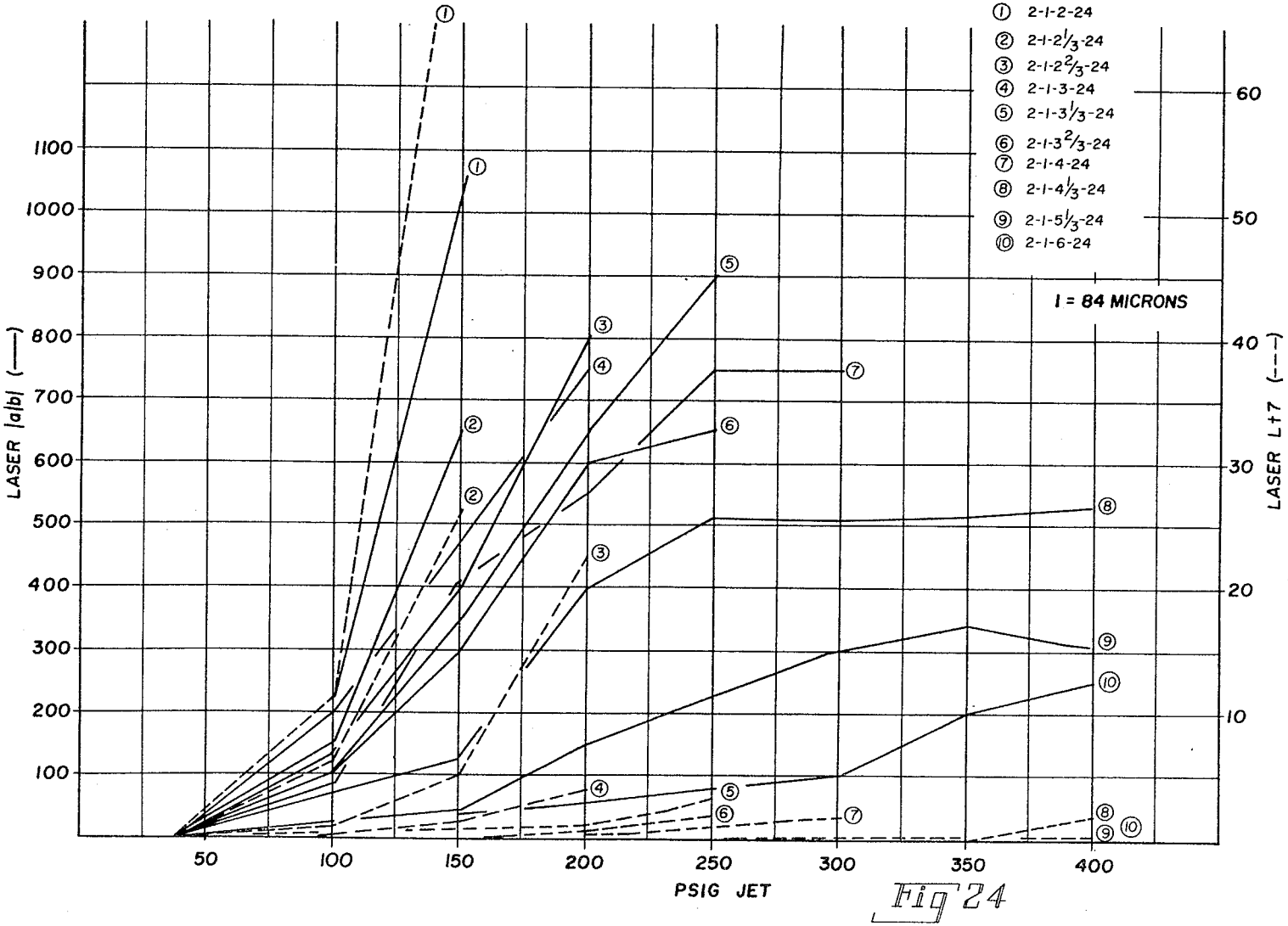
FIG. 24 is a graph showing the influence of center hole size in spinneret orifices and fracturing jet air pressures on laser a/b values and laser L+7 values.

FIG. 24 shows the influence of spinneret hole dimension c and fracturing jet air pressure on the laser absolute a/b value and the laser L+7 value. Notice in particular the surprising magnitude of the decrease in L+7 with increasing c at fracturing pressures of interest. This shows the amazing flexibility in the selection of free protruding end length which is within the scope of this invention.

Figure 25:
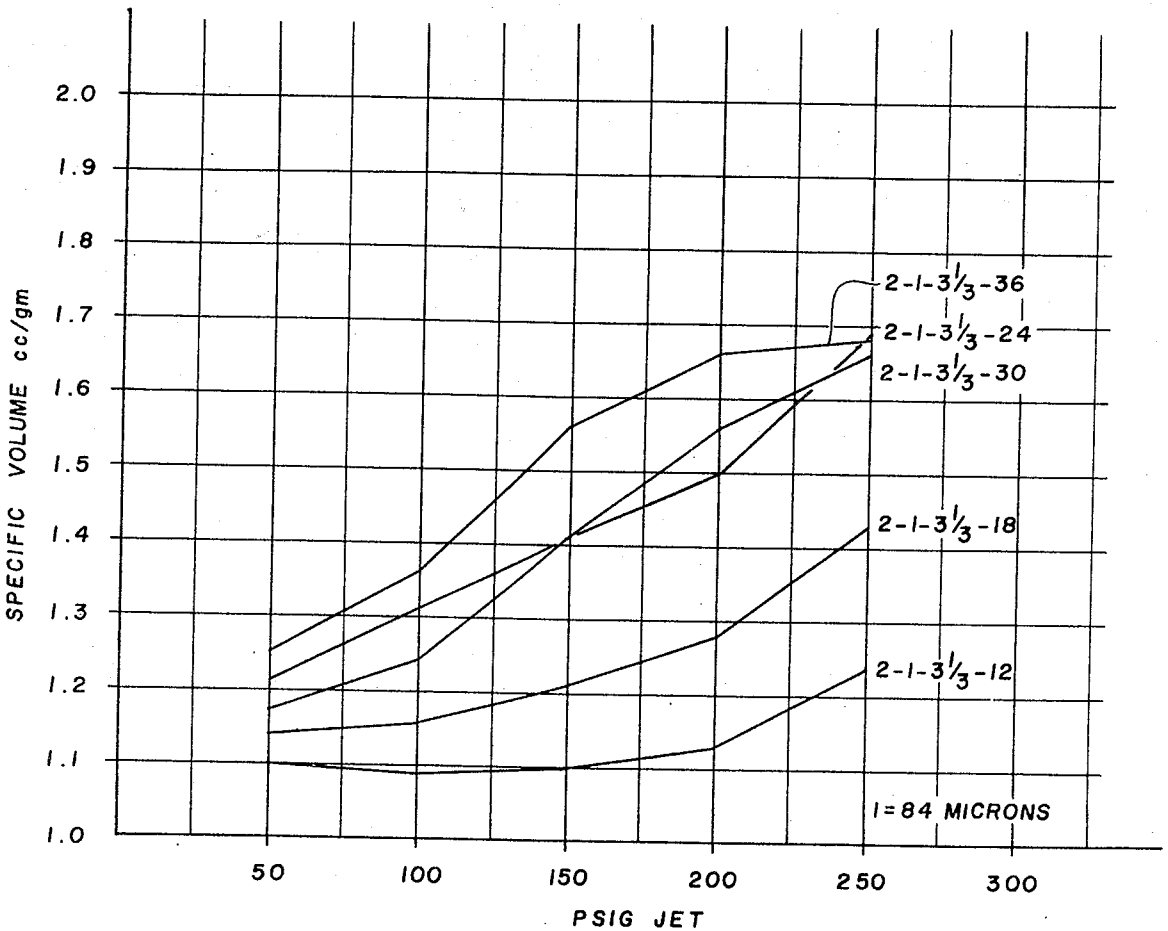
FIG. 25 is a graph showing the influence of wing length in the spinneret orifice and fracturing jet air pressure on the specific volume of the fractured yarn.
Figure 26:
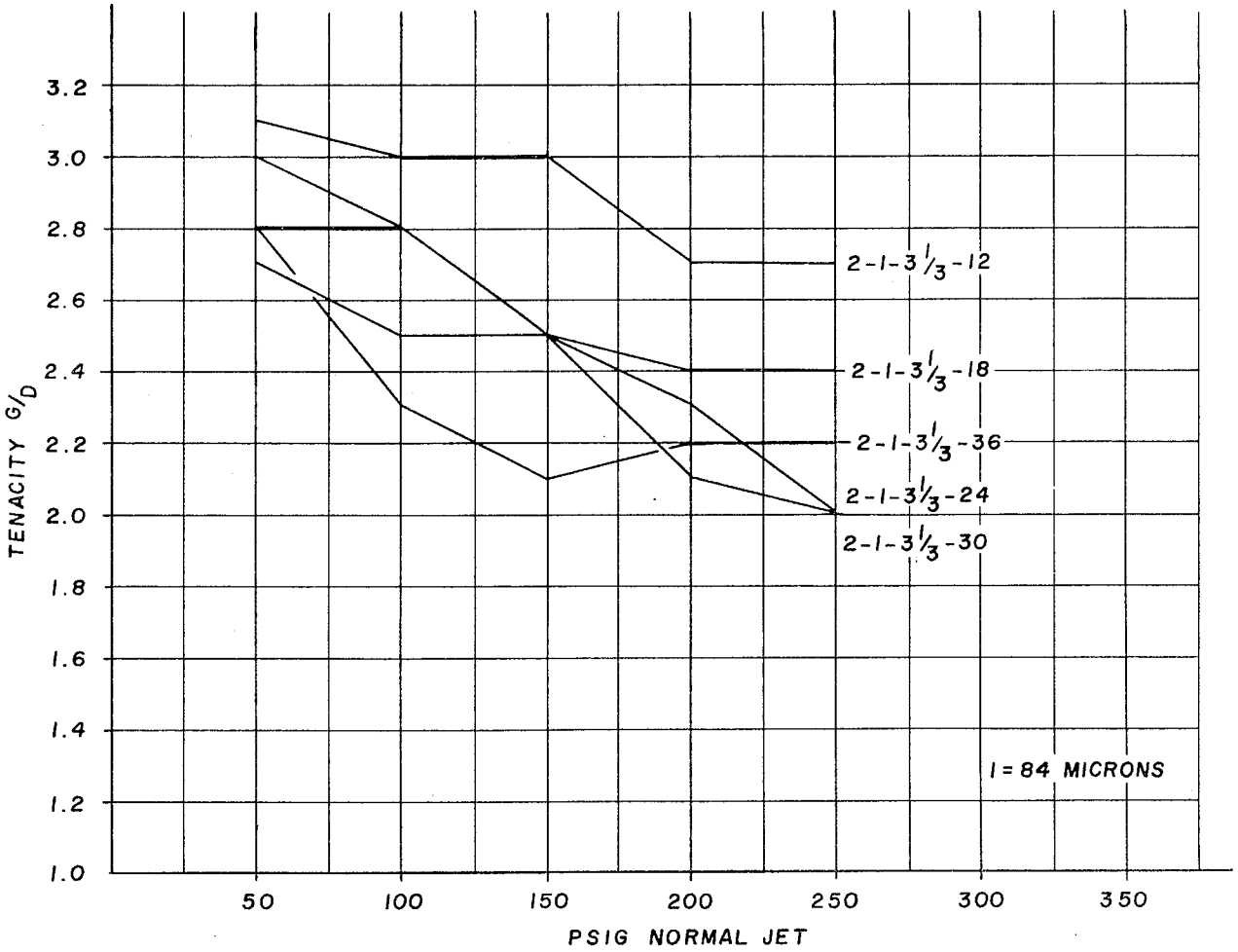
FIG. 26 is a graph showing the influence of wing length in the spinneret orifice and fracturing jet air pressure on fractured yarn tenacity.
Figure 27:
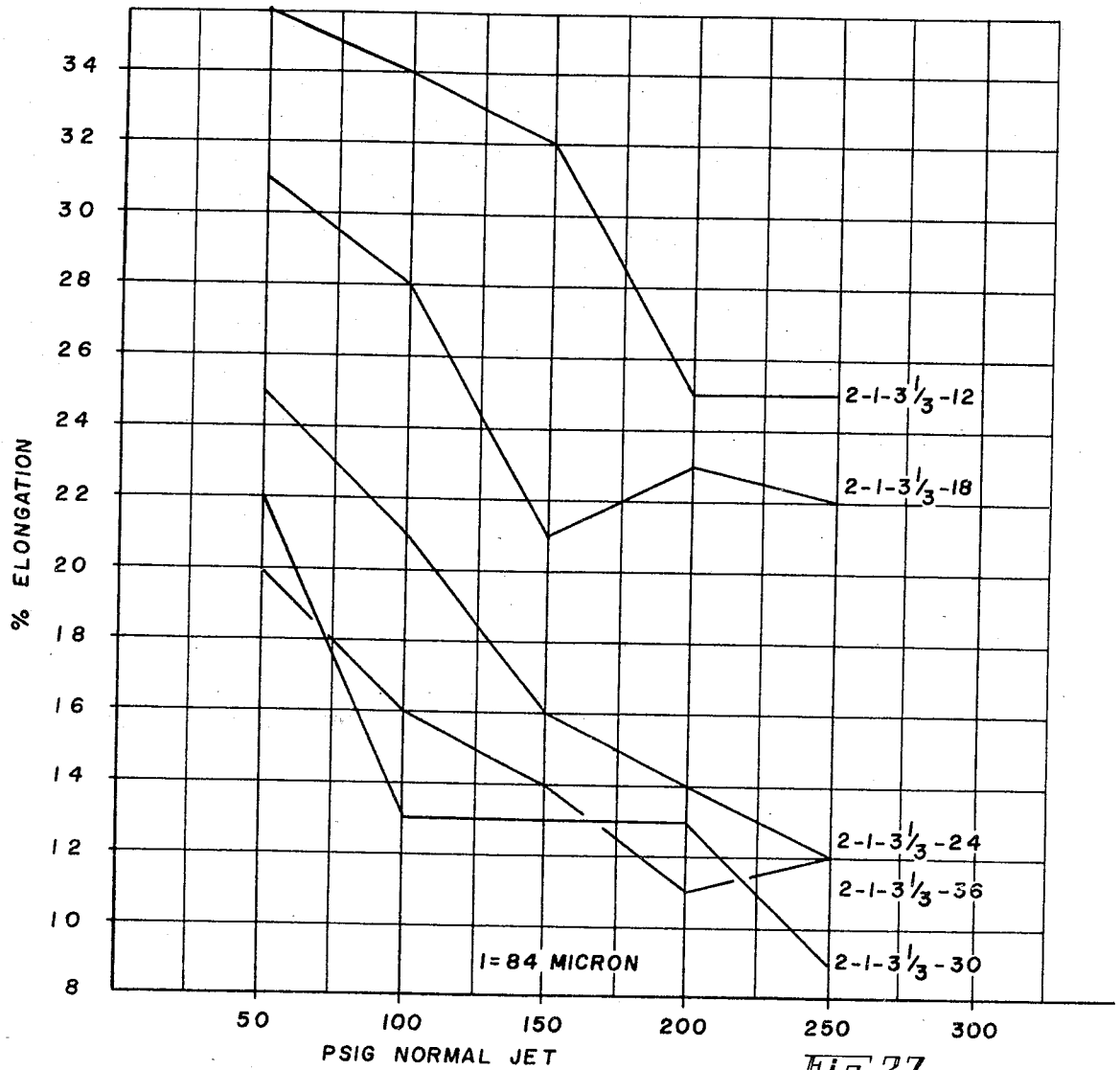
FIG. 27 is a graph showing the influence of wing length in the spinneret orifice and fracturing jet air pressures on the percent elongation in the fractured yarn.
Figure 28:
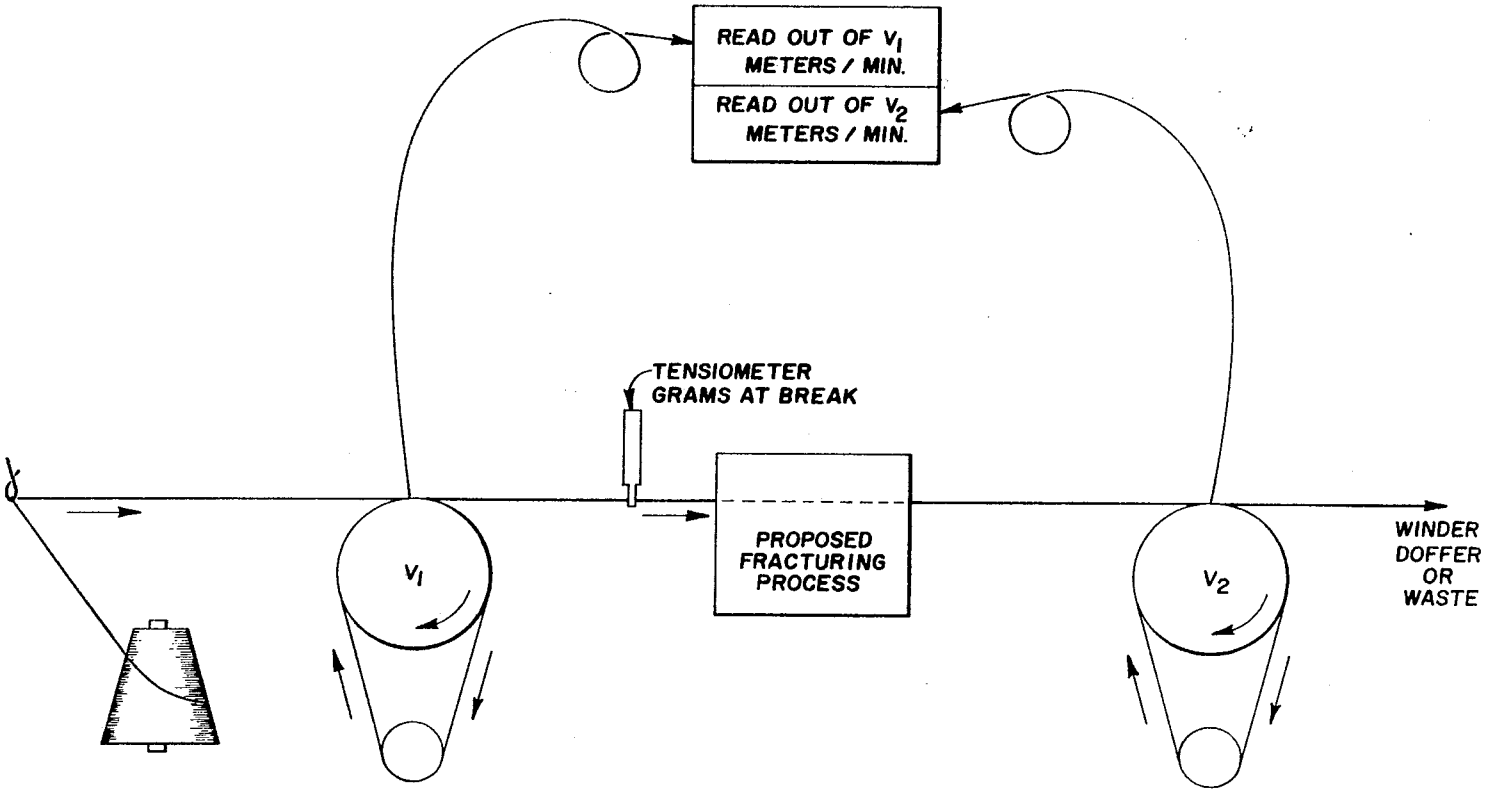
FIG. 28 is a sketch showing the equipment used to determine Bp* (brittleness parameter) of yarn to be fractured.
Figure 29:
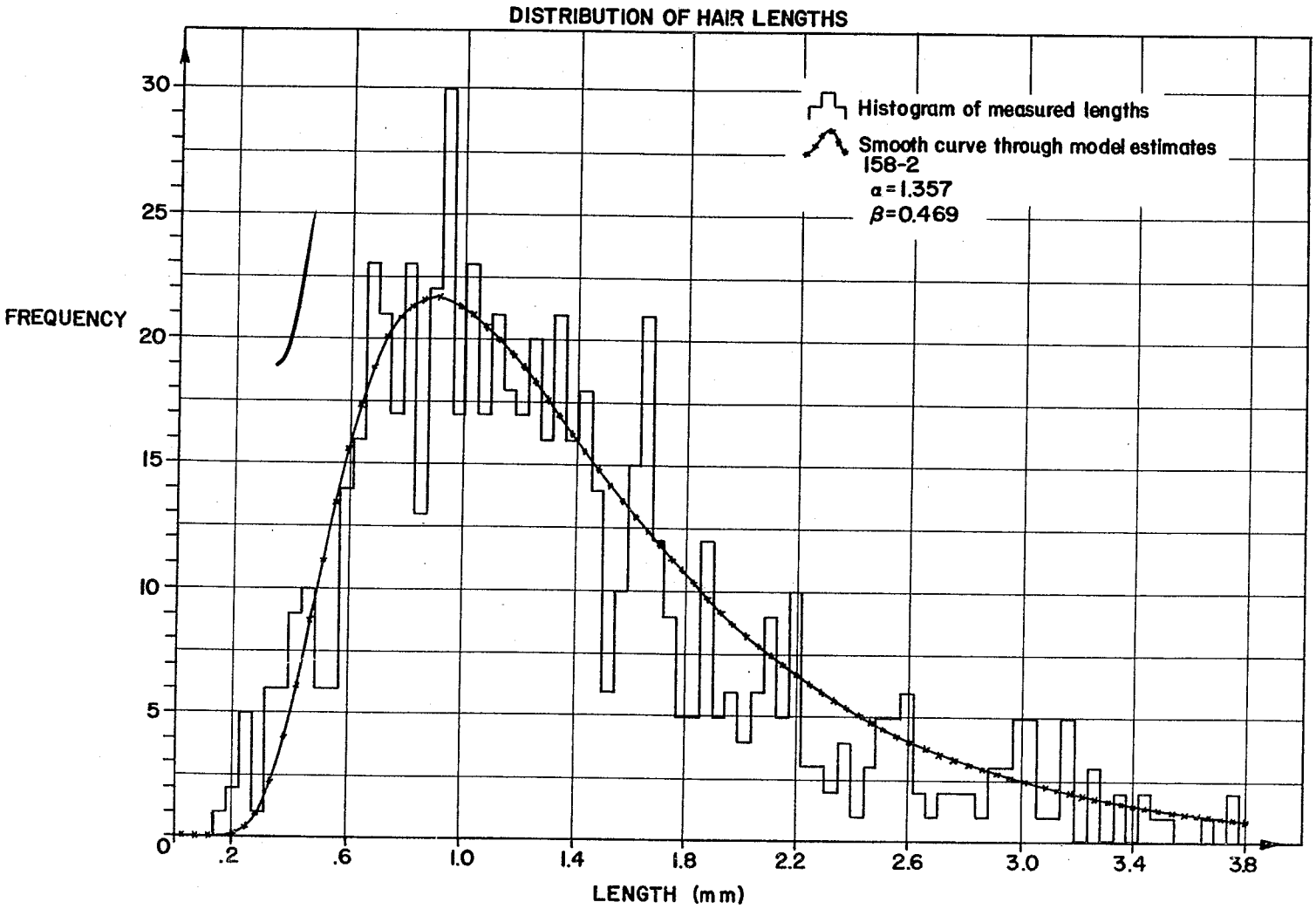
FIGS. 29 through 40 show the actual measured distributions for distances between events and lengths of events with the corresponding $\alpha$ and $\beta$ which best fit the data. The model prediction using the best set for $\alpha$ and $\beta$ is also shown in these figures.
Figure 30:
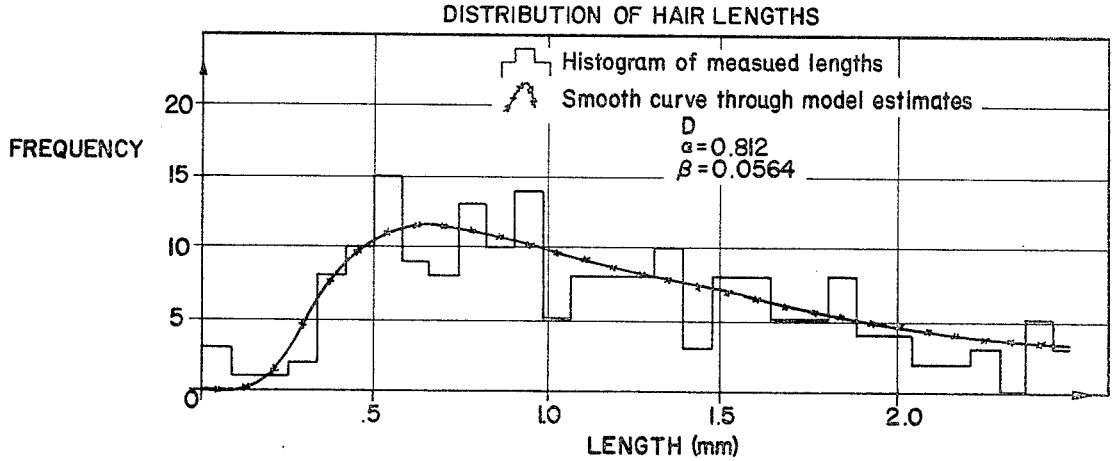
Figure 31:
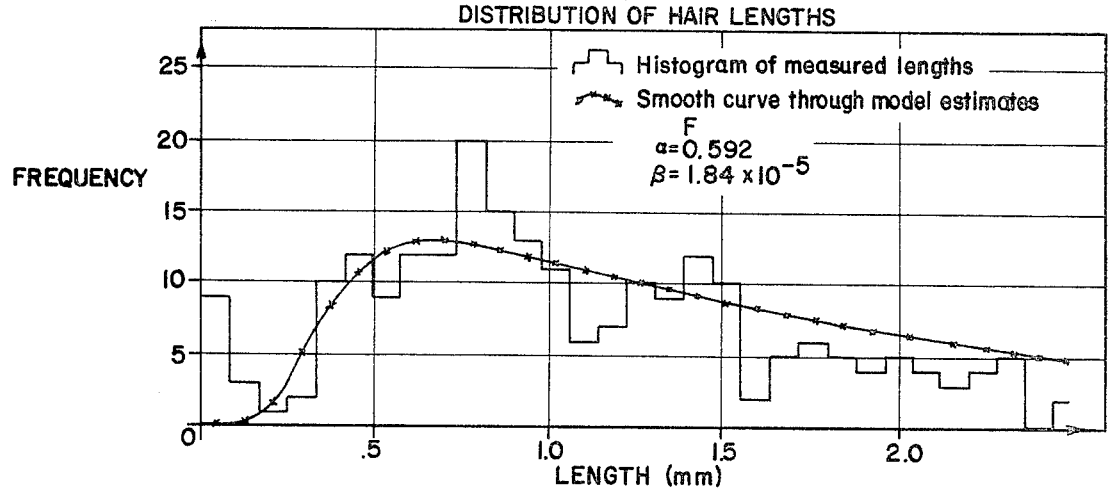
Figure 32:
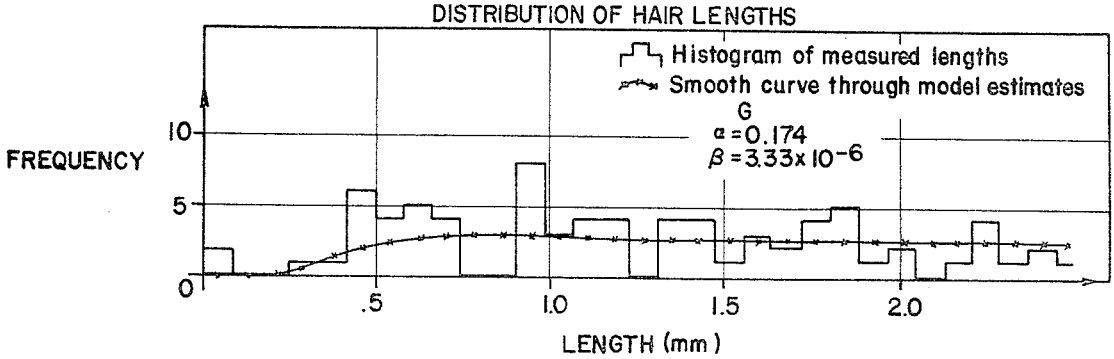
Figure 33:
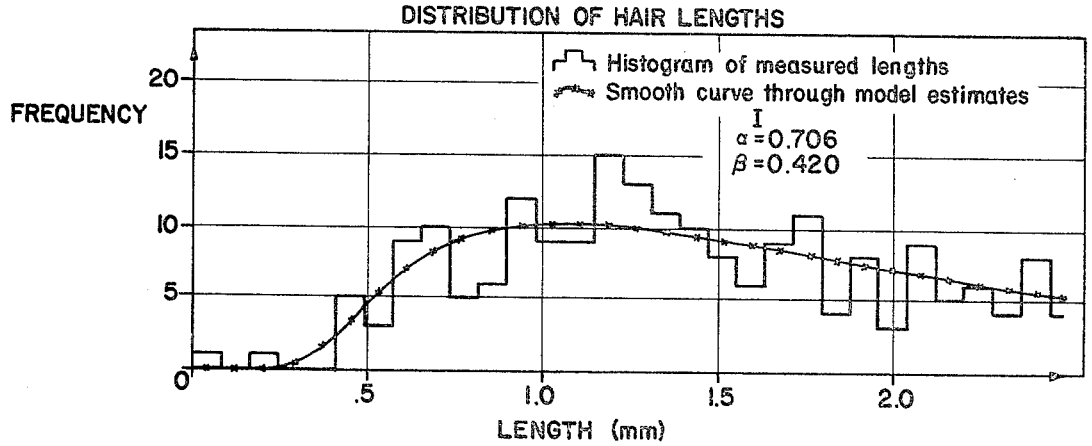
Figure 34:
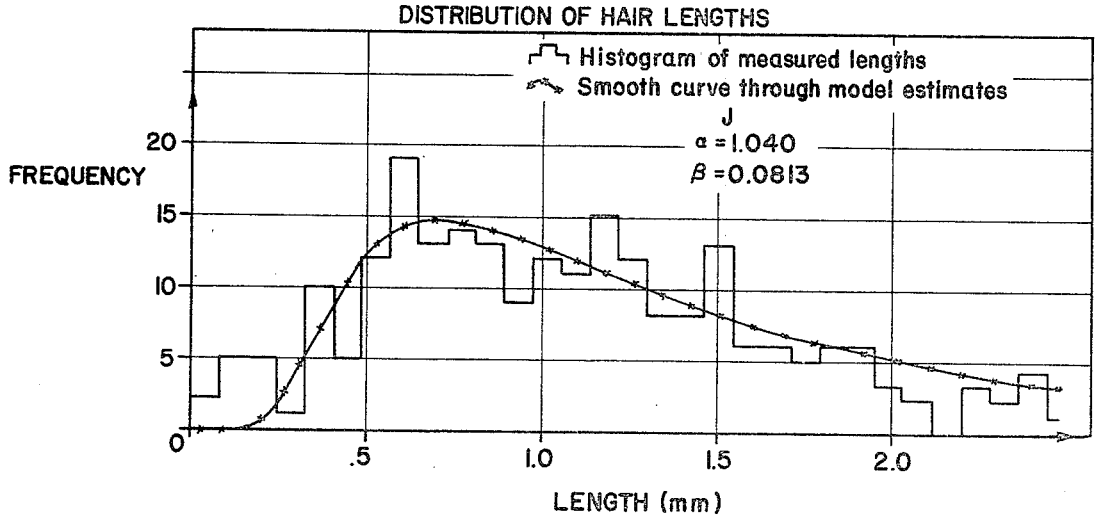
Figure 38:
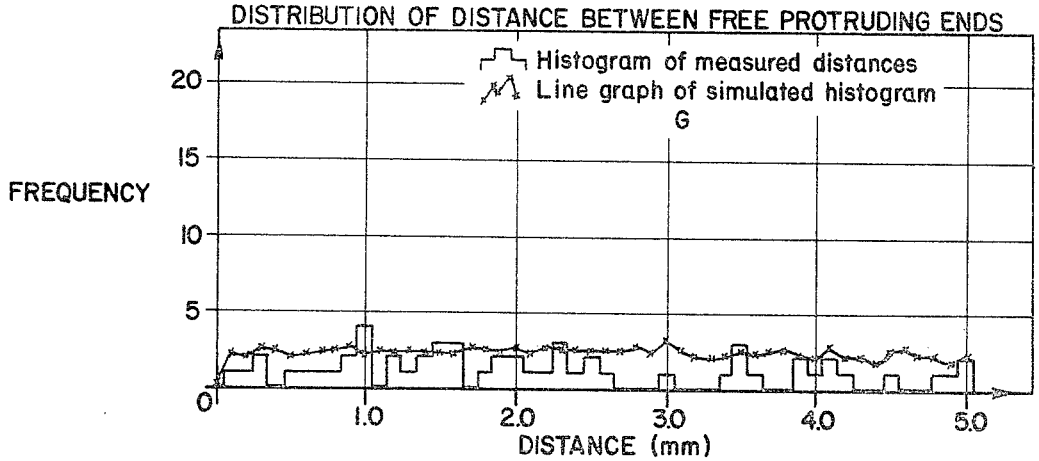
Figure 39:
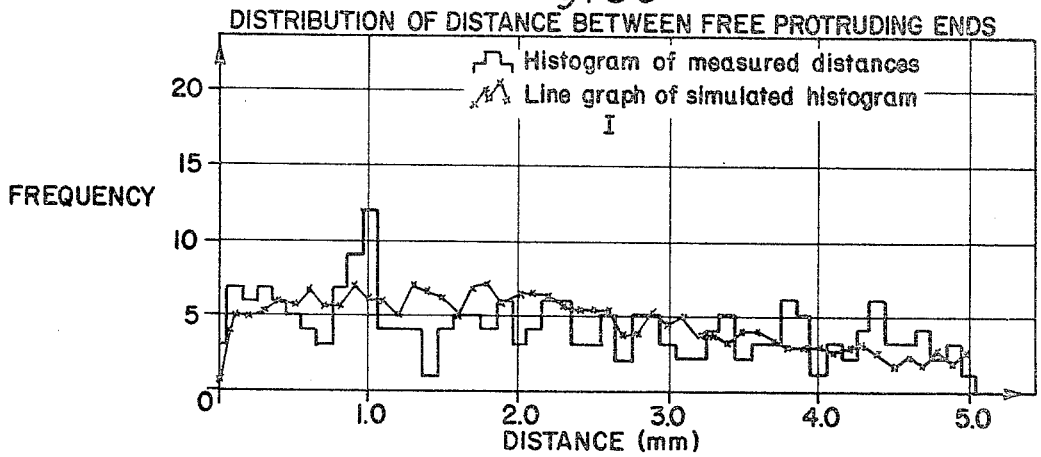
Figure 40:
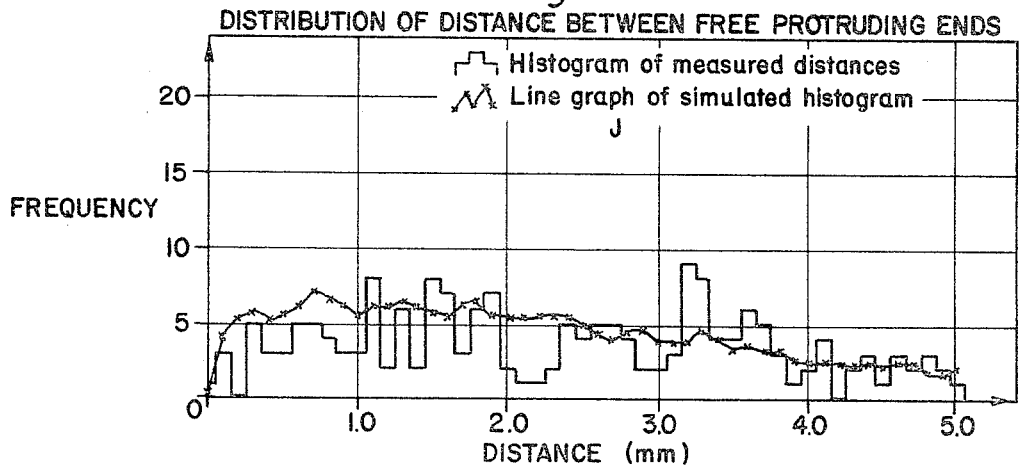
Figure 35:
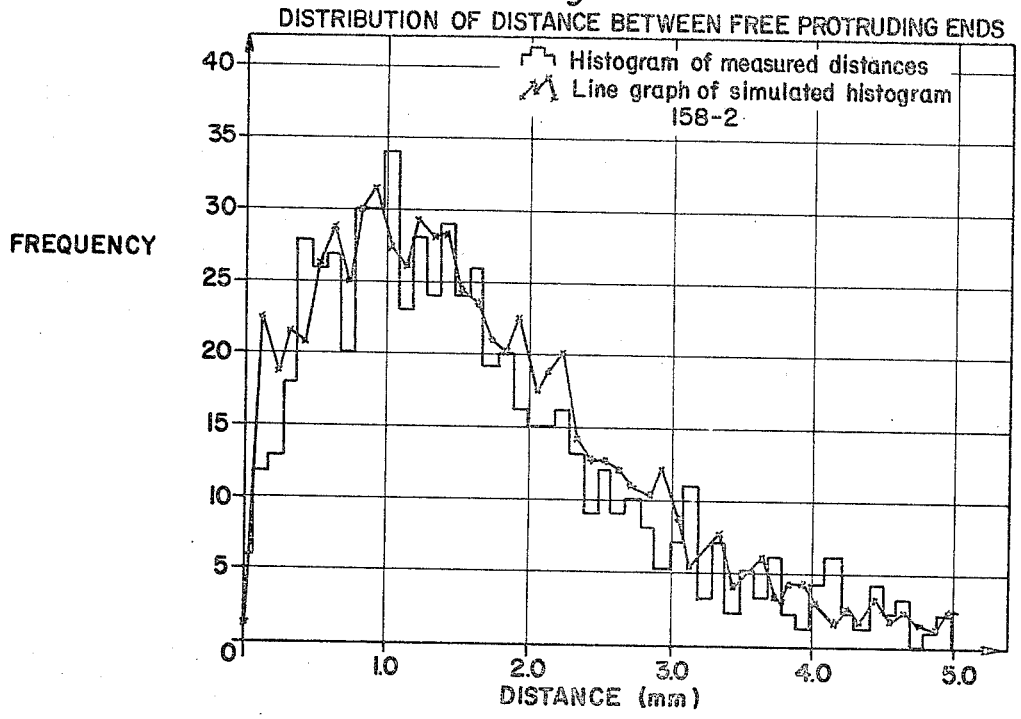
Figure 36:
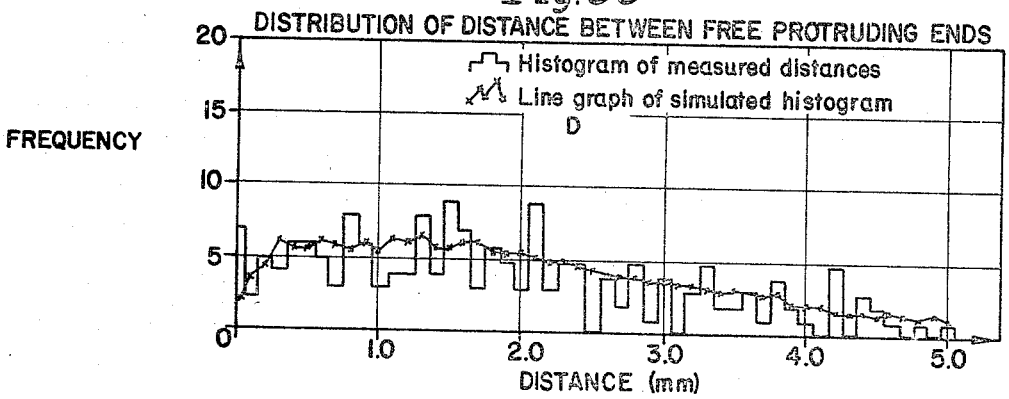
Figure 37:
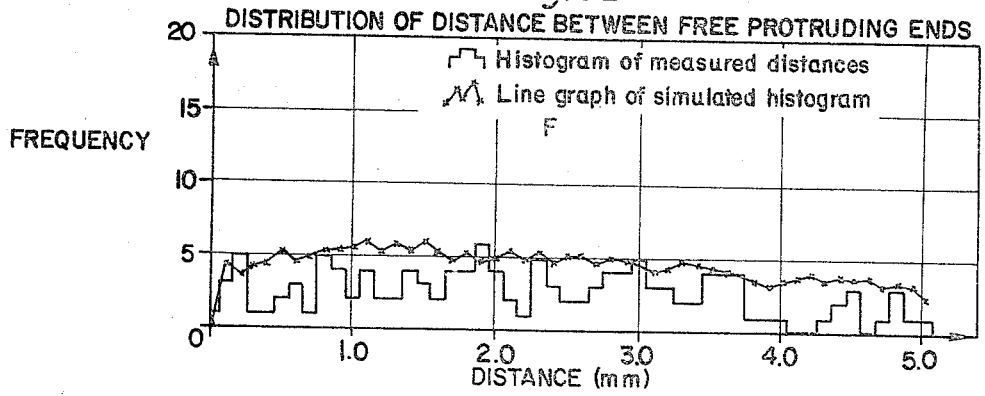

FIGS. 25, 26 and 27 show the influence of spinneret hole dimension d and fracturing jet air pressure on specific volume, tenacity, and percent elongation in the fractured yarn. Again notice the versatility in being able to select many different products with different fractured character for individual fabric end uses but which are all within the scope of the invention.

FIGS. 28–40 have been discussed earlier herein.

The invention will be further illustrated by the following examples although it will be understood that these examples are included merely for purposes of illustration and are not intended to limit the scope of the invention.

EXAMPLE 1

The filament shown in FIG. 7 was made using the following equipment and process conditions.

The basic unit of this spinning system design can be subdivided into an extrusion section, a spin block section, a quench section and a take-up section. A brief description of these sections follows.

The extrusion section of the system consists of a vertically mounted screw extruder with a 28:1 L/D screw $2\frac{1}{2}$ inches in diameter. The extruder is fed from a hopper containing polymer which has been dried in a previous separate drying operation to a moisture level $\leqq 0.003$ weight percent. Pellet poly(ethylene terephthalate) (PET) polymer (0.64 I.V.) containing 0.3% $TiO_2$ and 0.9% diethylene glycol (DEG) enters the feed port of the screw where it is heated and melted as it is conveyed vertically downward. The extruder has four heating zones of about equal length which are controlled, starting at the feed end at a temperature of 280, 285, 285, 280. These temperatures are measured by platinum resistance temperature sensors Model No. 1847-6-1 manufactured by Weed. The rotational speed of the screw is controlled to maintain a constant pressure in the melt (2100 psi) as it exits from the screw into the spin block. The pressure is measured by use of an electronic pressure transmitter [Taylor Model 1347.TF11334(158)]. The temperature at the entrance to the block is measured by a platinum resistance temperature sensor Model No. 1847-6-1 manufactured by Weed.

The spin block of the system consists of a 304 stainless steel shell containing a distribution system for conveying the polymer melt from the exit of the screw extruder to eight dual position spin packs. The stainless steel shell is filled with a Dowtherm liquid/vapor system for maintaining precise temperature control of the polymer melt at the desired spinning temperature of 280° C. The temperature of the Dowtherm liquid/vapor system is controlled by sensing the vapor temperature and using this signal to control the external Dowtherm heater. The Dowtherm liquid temperatures is sensed but is not used for control purposes.

Mounted in the block above each dual position pack are two gear pumps. These pumps meter the melt flow into the spin pack assemblies and their speed is precisely maintained by an inverter controlled drive system. The spin pack assembly consists of a flanged cylindrical stainless steel housing (198 mm. in diameter, 102 mm. high) containing two circular cavities of 78 mm. inside diameter. In the bottom of each cavity, a spinneret, as shown in FIG. 8, is placed followed by 300 mesh circular screen, and a breaker plate for flow distribution. Above the breaker plate is located a 300 mesh screen followed by a 20 mm. bed of sand (e.g., 20/40 to 80/100 mesh layers) for filtration. A stainless steel top with an entry port is provided for each cavity. The spin pack assemblies are bolted to the block using an aluminum gasket to obtain a no-leak seal. The pressure and temperature of the polymer melt are measured at the entrance to the pack (126 mm. above the spinneret exit). The spinneret used is that shown in FIGS. 8 and 9.

The quench section of the melt spinning system is described in U.S. Pat. No. 3,669,584. The quench section consists of a delayed quench zone near the spinneret separated from the main quench cabinet by a removable shutter with circular openings for passage of the yarn bundle. The delayed quench zone extends to approximately 2-3/16" below the spinneret. Below the shutter is a quench cabinet provided with means for applying force convected cross-flow air to the cooling and attenuating filaments. The quench cabinet is approximately $40\frac{1}{2}$" tall by $10\frac{1}{2}$" wide by $14\frac{1}{2}$" deep. Cross-flow air enters from the rear of the quench cabinet at a rate of 160 SCFM. The quench air is conditioned to maintain constant temperature at 77°±2° F. and humidity is held const. as measured by dew point at 64°±2° F. The quench cabinet is open to the spinning area on the front side. To the bottom of the quench cabinet is connected a quench tube which has an expanded end near the quench cabinet but narrows to dual rectangular sections with rounded ends (each approximately $6\frac{3}{8}$"×$15\frac{3}{4}$"). The quench tube plus cabinet is 16 feet in length. Air temperatures in the quench section are plotted as a function of distance from the spinneret in FIG. 19.

The take-up section of the melt spinning system consists of dual ceramic kiss roll lubricant applicators, two Godet rolls and a parallel package winder (Barmag SW4). The yarn is guided from the exit of the quench tube across the lubricant rolls. The RPM of the lubricant rolls is set at 32 RPM to achieve the desired level of one percent lubricant on the as-spun yarn. The lubricant is composed of 95 weight percent UCON-50HB-5100 (ethoxylated propoxylated butyl alcohol [viscosity 5100 Saybolt sec]), 2 weight percent sodium dodecyl benzene sulfonate and 3 weight percent POE5 lauryl potassium phosphate. From the lubricant applicators the yarn passes under the bottom half of the pull-out Godet and over the top half of the second Godet, both operating at a surface speed of 3014 meters/minute and thence to the winder. The Godet rolls are 0.5 m. in circumference and their speed is inverter controlled. The drive roll of the surface-driven winder (Barmag) is set such that the yarn tension between the last Godet roll and the winder is maintained at 0.1–0.2 grams/denier. The traverse speed of the winder is adjusted to achieve an acceptable package build. The as-spun yarn is wound on paper tubes which are 75 mm. inside diameter by 290 mm. long.

The filaments spun by the procedure set forth in Example 1 were draw-fractured to manufacture the yarn shown in FIG. 15. The drawing equipment is followed by an air-jet fracturing unit. The apparatus features a pretension zone and drawing zone, a heated feed roll, and electrically heated stabilization plates or a slit heater. The apparatus also incorporates a pinch roll at the feed Godet as shown in U.S. Pat. No. 3,539,680. In operation of the system the as-spun package is placed in the creel. The as-spun yarn is threaded around a pretension Godet and then six times around a heated feed roll. The feed roll/pretension speed ratio is maintained at 1.005. From the feed roll the yarn exits under the pinch roll and passes across the stabilization plate or slit heater to the draw roll where it is wrapped six times. The draw roll/feed roll speed ratio is selected based on the denier of the as-spun yarn and the desired final denier and the orientation characteristics of the as-spun yarn. The feed roll temperature was set at 83° C. However, for this yarn 105° C. is preferred. The stabilization plate temperature was set at 180° C. (this value may be varied from ambient temperature to 210° C.). For drafting only the yarn is passed from the draw roll to a parallel package winder (Leesona Model 959). For fracturing, the yarn passes from the draw roll through a fracturing air jet as described earlier herein, adjusted to a blow back of 2 psig., and shown in FIG. 20, and onto a forwarding Godet roll. The forwarding Godet roll is operating at a speed of 99.5% of that of the draw roll to provide a 0.5% overfeed through the fracturing jet.

The percent wing in the as-spun fiber cross-section is 40% and the ratio $L_T$/Dmin is 10.0. The wing-body interaction for this fiber is 15.1, calculated from 2000X photographs of the partially oriented yarn as described earlier.

$$\left(\frac{(78.3 - 23.3)23.3}{2(16.0)^2}\right)\left(\frac{57.2}{23.3}\right)^2 = 15.1$$

The conditions used to produce the yarn shown in FIG. 15 were as follows:

| | |
|---|---|
| Draw Ratio | 1.5 |
| Stabilization Plate Temp. | 180° C. |
| Feed Roll Temp. | 83° C. |
| Draw Tension | 75 grams |
| Fracturing Jet Air Pressure | 500 psig. |
| Compressed Air Temperature | 21° C. |
| Draw Roll Speed | 804 m./m. |
| Forwarding Godet Roll Speed | 800 m./m. |

The drawn and heatset but unfractured yarn had a tenacity of 2.1 G/D and an elongation of 21%. The yarn made as described had the following characteristics:

| | |
|---|---|
| Total Denier/Filament | 163/30 |
| Tenacity | 1.5 G/D |
| Elongation | 26% |
| Modulus | 38 G/D |
| Boiling Water Shrinkage | 4% |
| Uster Evenness | 1.4% |
| Specific Volume | 1.79 cc./gm. |
| Laser Absolute b Value | 1.52 |
| Laser Absolute a/b Value | 707 |
| Laser L+7 Value | 0 |

EXAMPLE 2

A melt spinning system comprising a polymer drying and feed section, an extrusion section, a spin block section, a quench section and a take-up section is utilized to spin a PET yarn.

The polymer drying and feed section consists of two hoppers placed vertically, one above the other. The hoppers have capacity for ~35 pounds of poly(ethylene terephthalate) (PET) pellet polymer each; they are steam jacketed and are equipped with a mechanical stirrer for agitation of the polymer during drying. Under standard operating conditions 35 pounds of PET pellet polymer (0.59 I.V., 0.3% $TiO_2$) are loaded into the top hopper which is subsequently heated to 120° C. and exhausted to a vacuum of 29 mm. Hg. The polymer is stirred under these conditions and held overnight to allow crystallization of the polymer and drying to a moisture level ≦0.005 weight percent. After drying the polymer is dropped into the lower hopper for feeding into the feed port of the extruder. The lower hopper is continuously purged with dry nitrogen to maintain the low moisture level of the dried polymer.

The extrusion section consists of a screw extruder with a 20:1 L/D screw of 1.5" diameter and an electrically heated barrel with three heating zones and a water jacketed cooling zone at the feed inlet port. Under standard extrusion conditions for PET the water flow to the cooling zone is adjusted to a level adequate to prevent sticking of the polymer in the entry port and to allow uniform feeding. The first heater zone (~4" in length) is controlled at a temperature of 220° C., the second heater zone (~4" in length) is controlled at a temperature of 245° C., and the third heater zone (~8" in length) in controlled at the selected spinning temperature. Screw speed is controlled by a pneumatic pressure controller which adjusts the screw RPM such that the pressure of the melt at the exit from the screw is maintained at a level of ~1000 psi.

The spin block section consists of an electrically heated dual spin block equipped with two gear pumps (Zenith) and two sandpack assemblies (Bouligny). The gear pumps are driven by individual electric motors which are controlled by Dodge SCR motor controls. The sandpack assemblies consist of a stainless steel housing containing, starting at the polymer exit end, the spinneret, a breaker plate for flow distribution, a 300 mesh screen, a 2-inch bed of 20/40 mesh sand and a stainless steel cover with an entry port. The sandpack assemblies are bolted into the spin block and an aluminum gasket is used to achieve a nonleaking seal. Polymer melt flows from the exit of the screw extruder into the feed ports of the gear pumps. The gear pumps subsequently meter the flow from the entry port through the sandpack assemblies where the polymer melt exits through the spinneret capillaries to form filaments. The pressure and temperature of the polymer melt at the exit from each gear pump are monitored with thermocouple-equipped pressure transducters (Dynisco). The electrical heaters on the spin block are controlled to maintain the melt temperature constant and at the desired level. The melt temperature measured at this point is referred to as the spinning temperature and is maintained at 295° C. in this example. The spinneret used has orifices shaped as shown in FIG. 9 with the unit dimension b being 126 microns.

The quench section consists of a quench cabinet (56" tall, 32" wide and 18" deep) enclosed on three sides and at top and bottom except for yarn passageways, but open in the front. The cabinet is connected at the top to the spin block and at the bottom to the quench tube. The quench tube has an expanded end near the spin cabinet but narrows to a cylindrical tube of 8" inside diameter. The quench tube is 11.7 feet in length. Air temperature profiles as measured near the spinning bundle as a function of distance below the spinneret are shown in FIG. 19, Curve B. The spinning cabinet is open to the ambient air of the spinning room which is maintained at ~25° C. Air is drawn from the spinning room into the quench tube by the filaments as they are drawn down into the take-up area. No force-convected cross-flow air is provided at the spinning cabinet.

The take-up section consists of dual ceramic kiss-roll lubricant applicators, two Godet rolls and a dual position Zinser high-speed winder. The yarn is guided from the exit of the quench tube across the lubricant rolls. The RPM of the lubricant rolls is set to achieve the desired level of lubricant on the as-spun yarn. Under standard conditions for polyester filament yarn, a texturing-type lubricant is applied at levels from 0.5–1.0 weight percent. From the lubricant applicators the yarn passes under the bottom half of the pull-out Godet and over the top half of the second Godet and thence to the winder. The Godet rolls are 0.5 meter in circumference and their speed is inverter controlled. The drive roll of the surface-driven winder (Zinser) is set such that the yarn tension between the last Godet roll and the winder is maintained at ~0.1 grams/denier. The transverse speed of the winder is adjusted according to manufacturer's recommendations to achieve an acceptable package build. With the winder the as-spun yarn is wound on paper tubes which are 5½" inside diameter by 7" long. The yarn is strung up in the take-up area by use of an air doffer. Package sizes of 10–15 pounds are readily wound on the Zinser winder. The surface speed of the Godet rolls is referred to as the spinning speed.

The percent wing in the spun fiber cross-section is 40% and the ratio of the width of the fiber to the wing thickness ($L_T$/Dmin) is 10.2. The wing-body interaction for this fiber is 22.8, calculated from measurements on 2000X photographs of the as-spun yarn as described earlier $$\left(\frac{(64.4 - 20.0)20.0}{2(14.0)^2}\right)\left(\frac{63.4}{20.0}\right)^2 = 22.8$$

This conditions used to draw and fracture the yarn were as follows:

| | |
|---|---|
| Raw Yarn Take-up Speed | 1000 m./m. |
| Draw Ratio | 2.73 |
| Stabilization Plate Temp. | 180° C. |
| Feed Roll Temperature | 83° C. |
| Draw Tension | 60 grams |
| Fracturing Air Pressure | 200 psig. |
| Compressed Air Temp. | 21°C. |
| Draw Roll Speed | 804 m./m. |
| Forwarding Godet Roll Speed | 800 m./m. |

The drawn but unfractured yarn properties were 2.8 G/D and 18 percent elongation.

The jet used is similar to that disclosed in U.S. Pat. No. 2,924,868, FIG. 1. The particular jet used was constructed so that the outer wall of the inner end portion of the needle has an inwardly tapered half angle of about 30° relative to the axis of the needle, and the needle exit opening is about 0.043 inch. The orifice plate has a thickness of about 0.063 inch, an entry opening of about 0.318 inch, and an exit opening of about 0.094 inch. The venturi has a length of about 1 13/16 inches, the diameter of the throat is about 0.100 inch and the length of the throat is about 0.0625 inch. The exit opening of the venturi diverges at an angle of about 10° or has a half angle of about 5°, as measured relative to the axis of the venturi. The jet was adjusted to give a blow back of 5 psig., as described earlier.

The yarn made as described had the following characteristics:

| | |
|---|---|
| Total Denier/Filament | 120/30 |
| Tenacity | 2.2 G/D |
| Elongation | 8% |
| Modulus | 61 D/F |
| Uster Evenness | 5.3% |
| Specific Volume | 1.75 cc./gm. |
| Laser Absolute b Value | 0.58 |
| Laser Absolute a/b Value | 407 |
| Laser L+7 Value | 9 |

EXAMPLE 3

A yarn was spun using the equipment, process conditions and polymer of Example 2 with the exception that in the quench area an electrically heated spinneret shield was added to the equipment. The shield was a metal cylinder (12" long and 6" inside diameter) which bolted to the bottom of the spin pack. The shield is provided with an electric heater which is controlled to maintain a set air temperature as measured one inch from the wall of the cylinder and 1½ inches from the spinneret face of approximately 150° C. The electrically heated jet shield provides delayed quenching of the filaments by maintaining higher air temperature in the vicinity of the spinneret. In general, it is well known that delayed quenching increases shape rounding for spinning of nonround cross-sections but with improved yarn uniformity. The temperature profile of the air downstream of the spinneret is that shown in FIG. 19, Curve C. Surprisingly the yarn spun by the above-described procedure does not provide a useful feed yarn for fracturing. It is evident from the following yarn properties that this is the case. The yarn was fractured identically to Example 2 except that the draw ratio was 3.0X and the draw tension was 80 grams.

The yarn made as described had the following characteristics:

| | |
|---|---|
| Total Denier/Filament | 120/30 |
| Tenacity | 3.8 G/D |
| Elongation | 14% |
| Modulus | 85 G/D |
| Uster Evenness | 4.1% |
| Specific Volume | 1.21 cc./gm. |
| Laser Absolute b Value | 0.28 |
| Laser Absolute a/b Value | 21 |
| Laser L+7 Value | 5 |

The percent wing in the fiber cross-section was 40% and the ratio of the width of the fiber to the wing thickness ($L_T$/Dmin) was 6.6. The wing-body interaction for this fiber, determined from measurements on 2000X photographs of the as-spun yarn, is $$\left(\frac{(73.1 - 28.2)28.2}{2(20.1)^2}\right)\left(\frac{47.9}{28.2}\right)^2 = 4.5$$

EXAMPLES 4–14

The runs identified as 4–14 in the table below were run under the conditions detailed in Example 2. The only change made is in the spinneret geometry as is set forth under "Spinneret" in the table and at the air pressure specified in the "Fracture Jet Air Pressure" column. Example 9 describes a yarn which fractures well but which has poor textile utility because of low tenacity, low elongation and high laser L+7. Example 10 describes a yarn which has poor fracturability. Examples 4–8 and 11–14 describe yarns of this invention which have good textile utility.

| Example No. | Spinneret | Tenacity G/D Fractured Yarn | Tenacity G/D Drawn Yarn | Percent Elongation Fractured Yarn | Percent Elongation Drawn Yarn | Specific Volume, cc/gm | Absolute b Value | Absolute a/b Value | L+7 Value |
|---|---|---|---|---|---|---|---|---|---|
| 4 | 2-1-3-24 | 2.2 | 3.0 | 11 | 24 | 1.74 | 0.68 | 750 | 4 |
| 5 | 2-1-2 §-24 | 1.7 | 3.0 | 8 | 23 | 1.82 | 0.54 | 800 | 23 |
| 6 | 2-1-3 §-24 | 2.5 | 3.1 | 20 | 25 | 1.47 | 1.05 | 600 | 1 |
| 7 | 2-1-4-24 | 2.8 | 3.3 | 20 | 29 | 1.37 | 1.20 | 550 | 0 |
| 8 | 2-1-6-24 | 3.3 | 3.7 | 23 | 34 | 1.40 | 0.72 | 250 | 0 |

-continued

| | | | | | | | | | |
|---|---|---|---|---|---|---|---|---|---|
| 9 | 2-1-2-24 | 1.5 | 3.1 | 5 | 29 | 1.80 | 0.44 | 1060 | 80 |
| 10 | 2-1-3 ⅛-18 | 2.4 | 3.2 | 21 | 39 | 1.28 | 0.95 | 94 | 1 |
| 11 | 2-1-3 ⅛-30 | 2.1 | 3.2 | 13 | 27 | 1.56 | 0.70 | 661 | 7 |
| 12 | 2-1-3 ⅛-36 | 2.2 | 3.2 | 11 | 26 | 1.66 | 0.89 | 998 | 3 |
| 13 | FIG. 17 | 2.4 | 3.7 | 8 | 16 | 2.29 | 0.56 | 1268 | 29 |
| 14 | FIG. 18 | 2.2 | 3.0 | 10 | 8 | 2.10 | 0.63 | 803 | 12 |

| Example No. | % of Fiber Cross-Sectional Area in Wing | % of Fiber Cross-Sectional Area in Body | Wing-Body Interaction | $L_t$/Dmin | Fracturing Jet Air psig. |
|---|---|---|---|---|---|
| 4 | 43 | 57 | 11.4 | 8.7 | 200 |
| 5 | 49 | 51 | 10.5 | 8.5 | 200 |
| 6 | 28 | 72 | 13.7 | 9.2 | 200 |
| 7 | 23 | 77 | 14.6 | 9.5 | 200 |
| 8 | 6 | 94 | 19.4 | 8.9 | 400 |
| 9 | 77 | 23 | 2.6 | 7.8 | 150 |
| 10 | 32 | 68 | 6.0 | 8.1 | 200 |
| 11 | 44 | 56 | 13.7 | 9.5 | 200 |
| 12 | 47 | 53 | 13.8 | 10.8 | 200 |
| 13 | 46 | 54 | 11.1 | 7.5 | 250 |
| 14 | 48 | 52 | 14.2 | 10.3 | 250 |

The invention has been described in detail with particular reference to certain preferred embodiments thereof, but it will be understood that variations and modifications can be effected within the spirit and scope of the invention.

We claim:

1. Process for draw-fracturing textile yarn, said process comprising uniformly drawing to a preselected level of textile utility a yarn comprising filaments having a wing-body interaction defined by $$\left(\frac{(Dmax - Dmin)Dmin}{2Rc^2}\right)\left(\frac{Lw}{Dmin}\right)^2 \geqq 10$$

where the ratio of the width of said filament to the width of said wing ($L_T$/Dmin) is $\leqq 30$, Dmax is the thickness or diameter of the body of the cross-section, Dmin is the thickness of the wing for essentially uniform wings and the minimum thickness close to the body when the thickness of the wing is variable, $R_c$ is the radius of curvature of the intersection of the wing and body, Lw is the overall length of an individual wing and $L_T$ is the overall length of the cross section, stabilizing said yarn to a specific gravity of at least 1.35; fracturing the wing portion of said filament utilizing fracturing means, and taking up said yarn.

2. Process of claim 1 wherein said fracturing means comprises a fluid fracturing jet operating at a brittleness parameter (Bp*) of about 0.03–0.8 for the yarn being fractured.

3. Process of claim 2 wherein said yarn is a poly(ethylene terephthalate) yarn.

4. Process of claim 2 wherein said yarn is a poly(ethylene terephthalate) yarn and said fracturing means is operated at a brittleness parameter (Bp*) of about 0.03–0.6.

5. Process of claim 4 wherein said fracturing means is operated at a brittleness parameter (Bp*) of about 0.03 to about 0.4.

6. Process of claim 2 wherein the specific volume of the fractured yarn is made to vary along the yarn strand by varying the fracturing jet air pressure.

* * * * *

UNITED STATES PATENT AND TRADEMARK OFFICE

CERTIFICATE OF CORRECTION

PATENT NO. : 4,332,761

DATED : June 1, 1982

INVENTOR(S) : Phillips et al

It is certified that error appears in the above-identified patent and that said Letters Patent is hereby corrected as shown below:

Column 3 delete lines 21 through 23 and substitute therefor:

---and $H(x) = \int_{-x}^{+x} \frac{\alpha}{2} e^{-\left[a\left(\frac{x+z}{2}\right) + \frac{2\beta}{(x+z)}\right]} . R\left(\frac{x-z}{2}\right) dz$---.

Column 3 delete line 26 and substitute therefor

---whose mean is $\mu_2$+lnw and variance is $\sigma_2^2$ or---.

Column 3 delete line 27 and substitute therefor

---where $\mu_2$ = mean value of ln(COTΘ)---.

Column 3 line 65 change "$\geq$ 30" to read ---$\leq$ 30---.

Column 7 line 18 change τ to read ---g---.

Column 17 line 1 change "$N = Ae^{Bx}$" to read

---$N = Ae^{-Bx}$---.

Column 17 line 5 change "$N = Ae^{Bx}$" to read

---$N = Ae^{-Bx}$---.

UNITED STATES PATENT AND TRADEMARK OFFICE

CERTIFICATE OF CORRECTION

PATENT NO. : 4,332,761

DATED : June 1, 1982

INVENTOR(S) : Phillips et al

It is certified that error appears in the above-identified patent and that said Letters Patent is hereby corrected as shown below:

Column 22 delete lines 18 through 20 and substitute therefor:

$$\text{---and } H(x) = \int_{-x}^{+x} \frac{\alpha}{2} e^{-\left[a\left(\frac{x+z}{2}\right) + \frac{2\beta}{(x+z)}\right]} . R\left(\frac{x-z}{2}\right) dz\text{---.}$$

Column 22 delete lines 44 through 46 and substitute therefor:

$$\text{---}\left.\begin{matrix}\mu_2\\ \sigma_2\end{matrix}\right\} = \text{constants defining angle of crack breaking---.}$$

Signed and Sealed this

Fifth Day of April 1983

[SEAL]

Attest:

GERALD J. MOSSINGHOFF

Attesting Officer

Commissioner of Patents and Trademarks